US007780274B2

(12) United States Patent
Takahashi

(10) Patent No.: US 7,780,274 B2
(45) Date of Patent: Aug. 24, 2010

(54) DROPLET EJECTION DEVICE

(75) Inventor: Yoshikazu Takahashi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 498 days.

(21) Appl. No.: 11/282,015

(22) Filed: Nov. 16, 2005

(65) Prior Publication Data

US 2006/0103698 A1 May 18, 2006

(30) Foreign Application Priority Data

Nov. 17, 2004 (JP) ..... 2004-333345

(51) Int. Cl.
*B41J 2/045* (2006.01)

(52) U.S. Cl. ..... 347/71

(58) Field of Classification Search ..... 347/347, 347/68, 11, 70–72; 310/311
See application file for complete search history.

(56) References Cited

U.S. PATENT DOCUMENTS 6,648,455 B2 11/2003 Takagi et al.
2003/0067510 A1* 4/2003 Isono ..... 347/68
2004/0119792 A1* 6/2004 Takahashi ..... 347/71

* cited by examiner

*Primary Examiner*—An H Do
(74) *Attorney, Agent, or Firm*—Frommer Lawrence & Haug LLP

(57) ABSTRACT

A droplet ejection device including: a cavity unit having nozzles and pressure chambers; an actuator unit including actuators corresponding to the respective pressure chambers, such that each actuator is operable to change a volume of the corresponding pressure chamber whereby a droplet is ejected from the corresponding pressure chamber through the corresponding nozzle; and a controller for controlling ejection of the droplet from each pressure chamber. The actuators are provided by at least four electrodes and a piezoelectric body. The pressure chambers are sorted into groups in at least two different manners, such that each pressure chamber belongs to at least two groups formed by sorting in the respective different manners. Each of the electrodes is arranged to correspond to at least one of the pressure chambers belonging to one of the groups formed by sorting in a corresponding one of the at least two different manners, so that each pressure chamber corresponds to at least two of the electrodes. The controller controls an electric voltage to be applied to each of the electrodes, for controlling ejection of the droplet from each of the pressure chambers.

15 Claims, 16 Drawing Sheets

FIG.10A

| | ROW 1 COLUMN A | ROW 2 COLUMN A | ROW 1 COLUMN B | ROW 2 COLUMN B |
|---|---|---|---|---|
| VOLTAGE TO CORRESPONDING ROW ELECTRODE | +2V | 0 | +2V | 0 |
| VOLTAGE TO CORRESPONDING COLUMN ELECTRODE | +V | +V | 0 | 0 |
| VOLTAGE TO CORRESPONDING COMMON ELECTRODE | 0 | 0 | +V | +V |
| DEFORMATION IN 5TH PIEZOELECTRIC LAYER | +1 | +1 | −1 | −1 |
| DEFORMATION IN 4TH PIEZOELECTRIC LAYER | +1 | +1 | −1 | −1 |
| DEFORMATION IN 3RD PIEZOELECTRIC LAYER | +2 | 0 | +1 | −1 |
| DEFORMATION IN 2ND PIEZOELECTRIC LAYER | +2 | 0 | +1 | −1 |
| SUM OF DEFORMATIONS | +6 | +2 | 0 | −4 |
| | EJECTION | NO EJECTION | NO EJECTION | NO EJECTION |

FIG.11A

| EXAMPLE 1 | ROW 1 COLUMN A | ROW 2 COLUMN A | ROW 1 COLUMN B | ROW 2 COLUMN B | VOLTAGE RATIO |
|---|---|---|---|---|---|
| VOLTAGE TO CORRESPONDING ROW ELECTRODE(V) | 20.00 | 0.00 | 20.00 | 0.00 | 2 |
| VOLTAGE TO CORRESPONDING COLUMN ELECTRODE(V) | 10.00 | 10.00 | 0.00 | 0.00 | 1 |
| VOLTAGE TO CORRESPONDING COMMON ELECTRODE(V) | 0.00 | 0.00 | 10.00 | 10.00 | 1 |
| DEFORMATION IN 5TH PIEZOELECTRIC LAYER(nm) | 2.50 | 2.50 | -2.50 | -2.50 | |
| DEFORMATION IN 4TH PIEZOELECTRIC LAYER(nm) | 2.50 | 2.50 | -2.50 | -2.50 | |
| DEFORMATION IN 3RD PIEZOELECTRIC LAYER(nm) | 5.00 | 0.00 | 2.50 | -2.50 | |
| DEFORMATION IN 2ND PIEZOELECTRIC LAYER(nm) | 5.00 | 0.00 | 2.50 | -2.50 | |
| SUM OF DEFORMATIONS(nm) | 15.00 | 5.00 | 0.00 | -10.00 | |
| | EJECTION | NO EJECTION | NO EJECTION | NO EJECTION | |

FIG.11B

| EXAMPLE 2 | ROW 1 COLUMN A | ROW 2 COLUMN A | ROW 1 COLUMN B | ROW 2 COLUMN B | VOLTAGE RATIO |
|---|---|---|---|---|---|
| VOLTAGE TO CORRESPONDING ROW ELECTRODE(V) | 20.00 | 0.00 | 20.00 | 0.00 | 4 |
| VOLTAGE TO CORRESPONDING COLUMN ELECTRODE(V) | 10.00 | 10.00 | 0.00 | 0.00 | 2 |
| VOLTAGE TO CORRESPONDING COMMON ELECTRODE(V) | 0.00 | 0.00 | 5.00 | 5.00 | 1 |
| DEFORMATION IN 5TH PIEZOELECTRIC LAYER(nm) | 2.50 | 2.50 | -1.25 | -1.25 | |
| DEFORMATION IN 4TH PIEZOELECTRIC LAYER(nm) | 2.50 | 2.50 | -1.25 | -1.25 | |
| DEFORMATION IN 3RD PIEZOELECTRIC LAYER(nm) | 5.00 | 0.00 | 3.75 | -1.25 | |
| DEFORMATION IN 2ND PIEZOELECTRIC LAYER(nm) | 5.00 | 0.00 | 3.75 | -1.25 | |
| SUM OF DEFORMATIONS(nm) | 15.00 | 5.00 | 5.00 | -5.00 | |
| | EJECTION | NO EJECTION | NO EJECTION | NO EJECTION | |

FIG.11C

| EXAMPLE 3 | ROW 1 COLUMN A | ROW 2 COLUMN A | ROW 1 COLUMN B | ROW 2 COLUMN B | VOLTAGE RATIO |
|---|---|---|---|---|---|
| VOLTAGE TO CORRESPONDING ROW ELECTRODE(V) | 20.00 | 0.00 | 20.00 | 0.00 | 4 |
| VOLTAGE TO CORRESPONDING COLUMN ELECTRODE(V) | 10.00 | 10.00 | 0.00 | 0.00 | 2 |
| VOLTAGE TO CORRESPONDING UPPER COMMON ELECTRODE(V) | 0.00 | 0.00 | 10.00 | 10.00 | 2 |
| VOLTAGE TO CORRESPONDING MIDDLE COMMON ELECTRODE(V) | 0.00 | 0.00 | 7.50 | 7.50 | 1.5 |
| VOLTAGE TO CORRESPONDING LOWER COMMON ELECTRODE(V) | 0.00 | 0.00 | -5.00 | -5.00 | -1 |
| DEFORMATION IN 5TH PIEZOELECTRIC LAYER(nm) | 2.50 | 2.50 | -2.50 | -2.50 | |
| DEFORMATION IN 4TH PIEZOELECTRIC LAYER(nm) | 2.50 | 2.50 | -1.88 | -1.88 | |
| DEFORMATION IN 3RD PIEZOELECTRIC LAYER(nm) | 5.00 | 0.00 | 3.13 | -1.88 | |
| DEFORMATION IN 2ND PIEZOELECTRIC LAYER(nm) | 5.00 | 0.00 | 6.25 | 1.25 | |
| SUM OF DEFORMATIONS(nm) | 15.00 | 5.00 | 5.00 | -5.00 | |
| | EJECTION | NO EJECTION | NO EJECTION | NO EJECTION | |

FIG.14

| | ROW 1 COLUMN A | ROW 2 COLUMN A | ROW 1 COLUMN B | ROW 2 COLUMN B |
|---|---|---|---|---|
| VOLTAGE TO CORRESPONDING ROW ELECTRODE | +V | 0 | +V | 0 |
| VOLTAGE TO CORRESPONDING COLUMN ELECTRODE | −V | −V | 0 | 0 |
| DEFORMATION IN 5TH PIEZOELECTRIC LAYER | +2 | +1 | +1 | 0 |
| DEFORMATION IN 4TH PIEZOELECTRIC LAYER | +2 | +1 | +1 | 0 |
| DEFORMATION IN 3RD PIEZOELECTRIC LAYER | +2 | +1 | +1 | 0 |
| DEFORMATION IN 2ND PIEZOELECTRIC LAYER | +2 | +1 | +1 | 0 |
| SUM OF DEFORMATIONS | +6 | +4 | +4 | 0 |
| | EJECTION | NO EJECTION | NO EJECTION | NO EJECTION |

DROPLET EJECTION DEVICE

This application is based on Japanese Patent Application No. 2004-333345 filed in Nov. 17, 2004, the content of which is incorporated hereinto by reference.

BACKGROUND OF THE INVENTION

1. Field of the Invention

The present invention relates to a droplet ejection device such as an inkjet head.

2. Discussion of Related Art

As a droplet ejection device, there is known an inkjet head operable to eject an ink droplet. U.S. Pat. No. 6,648,455 (corresponding to JP-2002-59547A) discloses an inkjet head including: (a) a cavity unit having a plurality of nozzles and a plurality of pressure chambers held in communication with the respective nozzles; (b) a piezoelectric actuator unit including a plurality of actuators operable to change a volume of a corresponding one of the pressure chambers; and (c) a flexible flat cable for supplying a drive voltage to each of the actuators.

In the inkjet head disclosed in U.S. Pat. No. 6,648,455, the plurality of pressure chambers are disposed in a rear portion of the cavity unit, and the piezoelectric actuator unit is superposed on the rear portion of the cavity unit such that the plurality of actuators correspond to the respective pressure chambers. The piezoelectric actuator unit includes (i) four individual-electrode layers each having a plurality of electrode layers which correspond to the respective pressure chambers and which are electrically independent from each other, (ii) three common-electrode layer each having a common electrode which is common to all the pressure chambers, and (iii) six piezoelectric layers each made of a piezoelectric material. The individual-electrode layers and the common-electrode layers are alternately arranged, with each of the piezoelectric layers being interposed between a corresponding adjacent pair of the individual-electrode and common-electrode layers. Each of the piezoelectric layers has a plurality of deformable portions each of which is interposed between the individual and common electrodes. Each of the deformable portions is polarized in a thickness direction of the piezoelectric layer. With application of a drive voltage between a selected one of the individual electrodes and the common electrode (that is grounded), a corresponding one of the deformable portions of the piezoelectric layer is caused to expand or contract in the thickness direction, thereby changing a volume of a corresponding one of the pressure chamber that are filled with an ink. As a result of change of the volume of the corresponding pressure chamber, the ink droplet is ejected through the nozzle held in communication with the corresponding pressure chamber.

In the disclosed inkjet head, the four individual-electrode layers and the three common-electrode layers are alternately arranged with each of the six piezoelectric layers being interposed between the corresponding pair of the individual-electrode and common-electrode layers, so that a total of six deformable portions correspond to each of the pressure chambers. For causing the ink to be ejected from a selected one of the pressure chambers, the drive voltages are concurrently applied to the four individual electrodes corresponding to the selected pressure chamber, whereby the six deformable portions are concurrently caused to expand. In this instance, the volume of the selected pressure chamber is changed by an amount corresponding to a sum of amounts of the expansions of the six deformable portions Meanwhile, the drive voltage is not applied to any one of the four individual electrodes corresponding to a non-selected one of the pressure chambers (from which the ink is not be ejected), so that the six deformable portions corresponding to the non-selected pressure chamber dot not expand at all, whereby the volume of the non-selected pressure chamber is not changed. It is noted that there is also known an arrangement in which the volume of each pressure chamber is changed by causing the corresponding deformable portions to concurrently contract rather than expand.

In the disclosed inkjet head in which the individual electrodes are arranged to correspond to the respective pressure chambers and to be electrically independent from each other, there are required the same number of individual electrodes as that of the pressure chambers, i.e., that of the nozzles. For example, where the inkjet head has the nozzles arranged in a matrix consisting of seventy-five rows and two columns, a total of 150 outputs have to be provided in a controller circuit operable to apply the drive voltage to each of the electrodes. That is, for merely applying the drive voltage to each electrode, the 150 outputs are required. Such a large number of the required outputs leads to an increase in cost required for the controller circuit. Further, since the inkjet head (to which the large number of outputs are to be supplied via the flexible flat cable) by a small-sized device, a large number of output lines have to be arranged in a high density within the flexible flat cable.

Still further, there is a tendency of increase in the number of nozzles provided in each head, for attending a need for recording or printing a higher density of full-color image at a higher speed. In the above-described conventional arrangement of the electrodes, if the number of columns is doubled to four, the required number of outputs of the individual electrodes is doubled to 300, whereby the costs required for the controller circuit and flexible flat cable are inevitably increased.

SUMMARY OF THE INVENTION

It is therefore an object of the present invention to provide a droplet ejection device which is equipped with a controller circuit operable to control ejection of a droplet such as ink droplet through each of a large number of nozzles, and which has an arrangement permitting a reduction in the number of outputs provided in the controller circuit and accordingly enabling the controller circuit to be manufactured at a reduced cost. This object may be achieved according to any one of first through third aspects of the invention which are described below.

The first aspect of the invention provides a droplet ejection device including: (a) a cavity unit having a plurality of nozzles and a plurality of pressure chambers which are held in communication with the respective nozzles; (b) an actuator unit including a plurality of actuators corresponding to the respective pressure chambers, such that each of the actuators is operable to change a volume of a corresponding one of the pressure chambers whereby a droplet is ejected from the corresponding one of the pressure chambers through a corresponding one of the nozzles; and (c) a controller operable to control ejection of the droplet from each of the pressure chambers. The plurality of actuators are provided by at least four electrodes and a piezoelectric body. The at least four electrodes are provided by a plurality of electrode layers each including at least two of the at least four electrodes, while the piezoelectric body is provided by at least one piezoelectric layer interposed between the plurality of electrode layers. The pressure chambers are sorted into groups in at least two different manners, such that each of the pressure chambers belongs to at least two groups which are formed by sorting in the respective different manners. Each of the at least four electrodes is arranged to correspond to at least one of the pressure chambers belonging to one of the groups which are formed by sorting in a corresponding one of the at least two different manners, so that each of the pressure chambers corresponds to at least two of the at least four electrodes. The controller controls an electric voltage that is to be applied to each of the at least four electrodes, for controlling ejection of the droplet from each of the pressure chambers.

In the present droplet ejection device, each of the pressure chambers is arranged to correspond to at least two of the above-described at least four electrodes. The controller controls the ejection of the droplet from each of the pressure chambers, by controlling the electric voltage that is to be applied to each of the at least two electrodes to which the each of the pressure chambers corresponds. Since each of the electrodes is arranged to correspond to the pressure chamber or chambers belonging to the same group (which is formed by sorting in a corresponding one of the at least two different manners), the number of the required electrodes can be made smaller than the number of the pressure chambers (i.e., the number of the nozzles). It is therefore possible to reduce the number of outputs that are to be supplied from the controller, whereby the controller circuit can be produced in a reduced cost. Where the outputs are transmitted through output lines that are arranged in a flexible flat cable, the reduction of the number of the outputs eliminates or alleviates necessity of arranging the output lines in a high density.

According to the second aspect of the invention, in the droplet ejection device in the first aspect of the invention, the at least four electrodes includes (i) a plurality of first electrodes provided by a first electrode layer as one of the plurality of electrode layers and (ii) and a plurality of second electrodes provided by a second electrode layer as one of the plurality of electrode layers. The pressure chambers are sorted in first and second manners as the at least two different manners, such that each of the pressure chambers belongs to one of the groups formed by sorting in the first manner and one of the groups formed by sorting in the second manner. Each of the first electrodes is arranged to correspond to at least one of the pressure chambers belonging to one of the groups formed by sorting in the first manner, while each of the second electrodes is arranged to correspond to at least one of the pressure chambers belonging to one of the groups formed by sorting in the second manner, so that each of the pressure chambers corresponds to one of the first electrodes and one of the second electrodes. The controller controls the ejection of the droplet from each of the pressure chamber, by controlling the electric voltage that is to be applied to each of the first and second electrodes.

In the droplet ejection device constructed according to the second aspect of the invention, each of the first electrodes corresponds to at least one of the pressure chambers belonging to one of the groups formed by sorting in the first manner, while each of the second electrodes corresponds to at least one of the pressure chambers belonging to one of the groups formed by sorting in the second manner, so that each of the pressure chambers corresponds to one of the first electrodes and one of the second electrodes. Since each of the first and second electrodes is arranged to correspond to the pressure chamber or chambers belonging to the same group (which is formed by sorting in the first or second manner), the number of the required electrodes can be made smaller than the number of the pressure chambers.

According to the third aspect of the invention, in the droplet ejection device in the second aspect of the invention, the pressure chambers are arranged in a matrix including a plurality of rows and columns, such that at least two of the pressure chambers arranged in a same one of the rows belong to a same one of the groups formed by sorting in the first manner, and such that at least two of the pressure chambers arranged in a same one of the columns belong to a same one of the groups formed by sorting in the second manner. Each of the first electrodes is configured to straddle the at least two of the pressure chambers which are arranged in the same row and which belong to the same group formed by sorting in the first manner, while each of the second electrodes is configured to straddle the at least two of the pressure chambers which are arranged in the same column and which belong to the same group formed by sorting in the second manner.

In the droplet ejection device constructed according to the third aspect of the invention, each of the first electrodes straddles the at least two of the pressure chambers which are arranged in the same row and which belong to the same group formed by sorting in the first manner, while each of the second electrodes straddles the at least two of the pressure chambers which are arranged in the same column and which belong to the same group formed by sorting in the second manner. Since each of the first and second electrodes is arranged to correspond to the at least two pressure chambers which are arranged in the same row or column belonging to the same group (which is formed by sorting in the first or second manner), the number of the required electrodes can be made smaller than the number of the pressure chambers.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which:

FIG. 10A is a table showing an example of relationship between a drive voltage applied to each electrode and an amount of deformation of each piezoelectric layer;

FIG. 11A is a table showing a relationship between the drive voltage applied to each electrode and the amount of deformation of each piezoelectric layer in Example 1;

FIG. 11B is a table showing a relationship between the drive voltage applied to each electrode and the amount of deformation of each piezoelectric layer in Example 2;

FIG. 11C is a table showing a relationship between the drive voltage applied to each electrode and the amount of deformation of each piezoelectric layer in Example 3;

FIG. 14 is a table showing a relationship between the drive voltage applied to each electrode and the amount of deformation of each piezoelectric layer in the second embodiment.

DETAILED DESCRIPTION OF THE PREFERRED EMBODIMENTS

Figure 1:
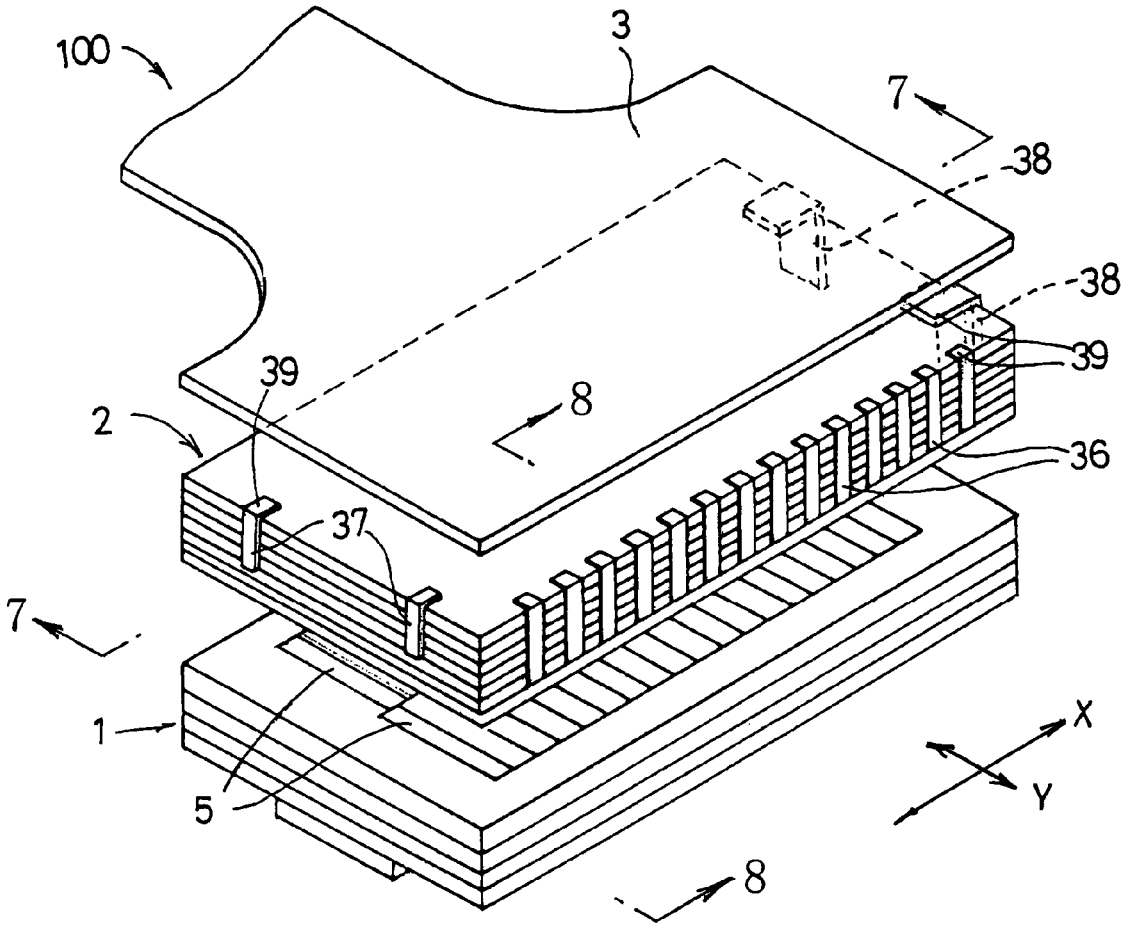
FIG. 1 is a perspective and exploded view showing an inkjet head constructed according to a first embodiment of the invention.

Referring to FIGS. 1-9, there will be described an inkjet head 100 constructed according to a first embodiment of the invention. As shown in FIG. 1, the inkjet head 100 includes a cavity unit 1, a piezoelectric actuator unit 2 and a flexible flat cable 3. The cavity unit 1 has a plurality of nozzles 4 arranged on its front face (lower face as seen in FIG. 1), and a plurality of pressure chambers 5 held in communication with the respective nozzles 4. The actuator unit 2 is attached to a rear face (upper face as seen in FIG. 1) of the cavity unit 1, and has a plurality of actuators 20 corresponding to the respective pressure chambers 5. The flexible flat cable 3 is connected to a rear face of the actuator unit 2, for supplying drive voltages to the actuator unit 2. This inkjet head 100 is arranged such that an ink droplet is ejected downwardly through each of the nozzles 4 opening in the front face of the cavity unit 1 (see FIG. 8).

Figure 2:
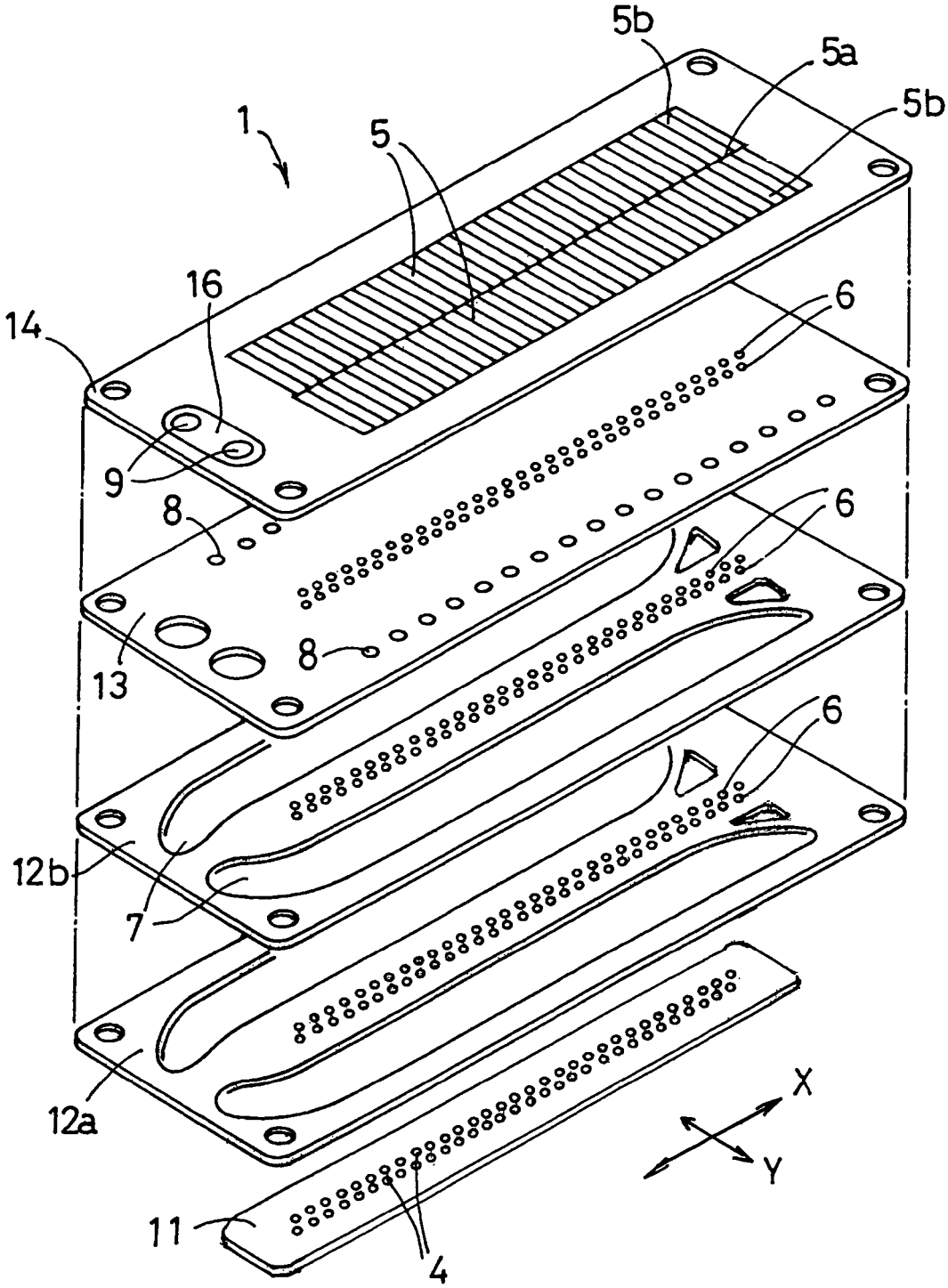
FIG. 2 is a perspective and exploded view showing a cavity unit of the inkjet head of FIG. 1.
Figure 3:
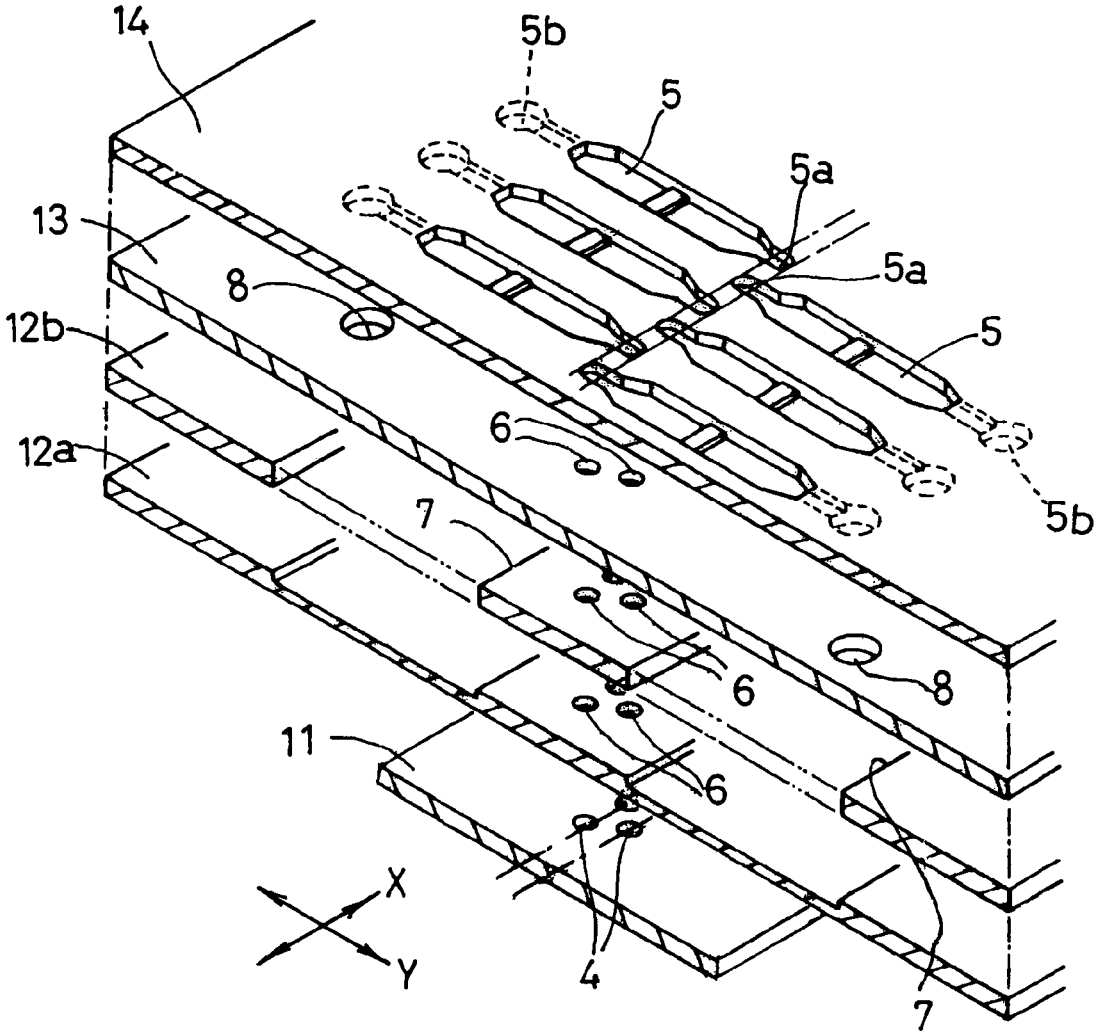
FIG. 3 is a perspective and exploded view in enlargement showing a part of the cavity unit of FIG. 2.

As shown in FIGS. 2 and 3, the cavity unit 1 includes a total of five thin flat plates consisting of a nozzle plate 11, two manifold plates 12*a*, 12*b*, a base plate 13 and a cavity plate 14. The five plates 11, 12*a*, 12*b*, 13, 14 are superposed on one another, with an adhesive being interposed between each adjacent pair of the plates having respective surfaces opposed to each other.

The nozzle plate 11, which is provided by a lowermost one of the five plates, defines the multiplicity of nozzles 4 through which the ink droplet is to be ejected. The nozzles 4 have a micro diameter and are spaced apart from one another by a micro distance. The cavity plate 14, which is provided by an uppermost one of the five plates, defines the multiplicity of pressure chambers 5 which are arranged in a matrix including a plurality of rows and columns, namely, arranged in a m-by-n matrix where each of "m" and "n" represents an integer number not smaller than two. In the present embodiment, the nozzles 4 and the pressure chambers 5 are arranged in a 75-by-2 matrix consisting of a total of seventy-five rows (m=75) and a total of two columns (n=2), although the number of rows is illustrated to be smaller in each of the drawings, than actually it is. The seventy-five rows of the nozzles 4 and the pressure chambers 5 are arranged in a first direction (X direction) which corresponds to a longitudinal direction of the nozzle plate 11 and the cavity plate 14. The two columns of the nozzles 4 and the pressure chambers 5 are arranged in a second direction (Y direction) which is orthogonal to the first direction and which corresponds to a width direction of the nozzle plate 11 and the cavity plate 14. It is noted that the nozzles 4 and the pressure chambers 5 are arranged in a zigzag pattern.

As shown FIG. 3, each of the pressure chambers 5 is elongated in the above-described second direction (Y direction), and has longitudinally opposite end portions 5*a*, 5*b*. Each pressure chamber 5 is held in communication at the end portion 5*a* with the respective nozzles 4 of the nozzle plate 11 via respective communication holes 6 having a micro diameter. The communication holes 6 are formed through the base plate 13 and two manifold plates 12*a*, 12*b*, and are arranged in the zigzag pattern. Each pressure chamber 5 is held in communication at the other end portion 5*b* with respective manifold or common chambers 7 via respective through holes 8 that are formed in widthwise opposite end portions of the base plate 13. It is noted that the other end portion 5*b* of each pressure chamber 5 is provided by a recess formed in a lower face of the cavity plate 14 so as to open only downwardly.

The two manifold or common chambers 7 are formed in the two manifold plates 12*a*, 12*b*, so as to be elongated in the above-described first direction (X direction) and extend along the respective columns of the nozzles 4. As shown in FIGS. 2 and 3, each of the two common chambers 7 is provided by an enclosed chamber that is defined by an elongated recess formed in an upper face of the lower manifold plate 12*a*, an elongated hole formed through the upper manifold plate 12*b* and a lower surface of the base plate 13. Each of the common chambers 7 extends in the first direction (X direction), so as to overlap with a portion of each of the pressure chambers 5 as seen in a plan view of the cavity unit 1, i.e., as viewed in a direction in which the five plates 11, 12*a*, 12*b*, 13, 14 are superposed on one another.

As shown in FIG. 2, two ink supply holes 9 are formed through a longitudinal end portion of the cavity unit 14, so as to serve as ink inlets of the cavity unit 1. Each of the two ink supply holes 9 is held in communication with a longitudinal end portion of a corresponding one of the common chambers 7, via a through hole formed through the base plate 13. A filter body 16 is bonded to the upper face of the cavity plate 14, by adhesive or the like, and covers the ink supply holes 9, so as to capture dust or other foreign matters contained in the ink supplied from an ink source.

In the present embodiment, each of the five plates 11, 12*a*, 12*b*, 13, 14 of the cavity unit 1 has a thickness of about 50-150 μm. The nozzle plate 11 is made of a synthetic resin such as polyimide-based resin, while each of the other plates 12*a*, 12*b*, 13, 14 is formed of a steel alloy including 42% of nickel. Each of the nozzles 4 has a diameter of about 25 μm.

In the cavity unit 1 constructed as described above, there are defined ink delivery channels for delivering the ink from the ink supply holes 9 to the nozzles 4. The ink supplied from the ink source to the cavity unit 1 is first supplied from the ink supply holes 9 to the common chambers 7, and then distributed to the pressure chambers 5 via the through-holes 8 of the base plate 13. With activation of the piezoelectric actuator unit 2, the ink is delivered from the pressure chambers 5 to the nozzles 4 via the communication holes 6 (see FIGS. 2, 3 and 8).

Figure 4:
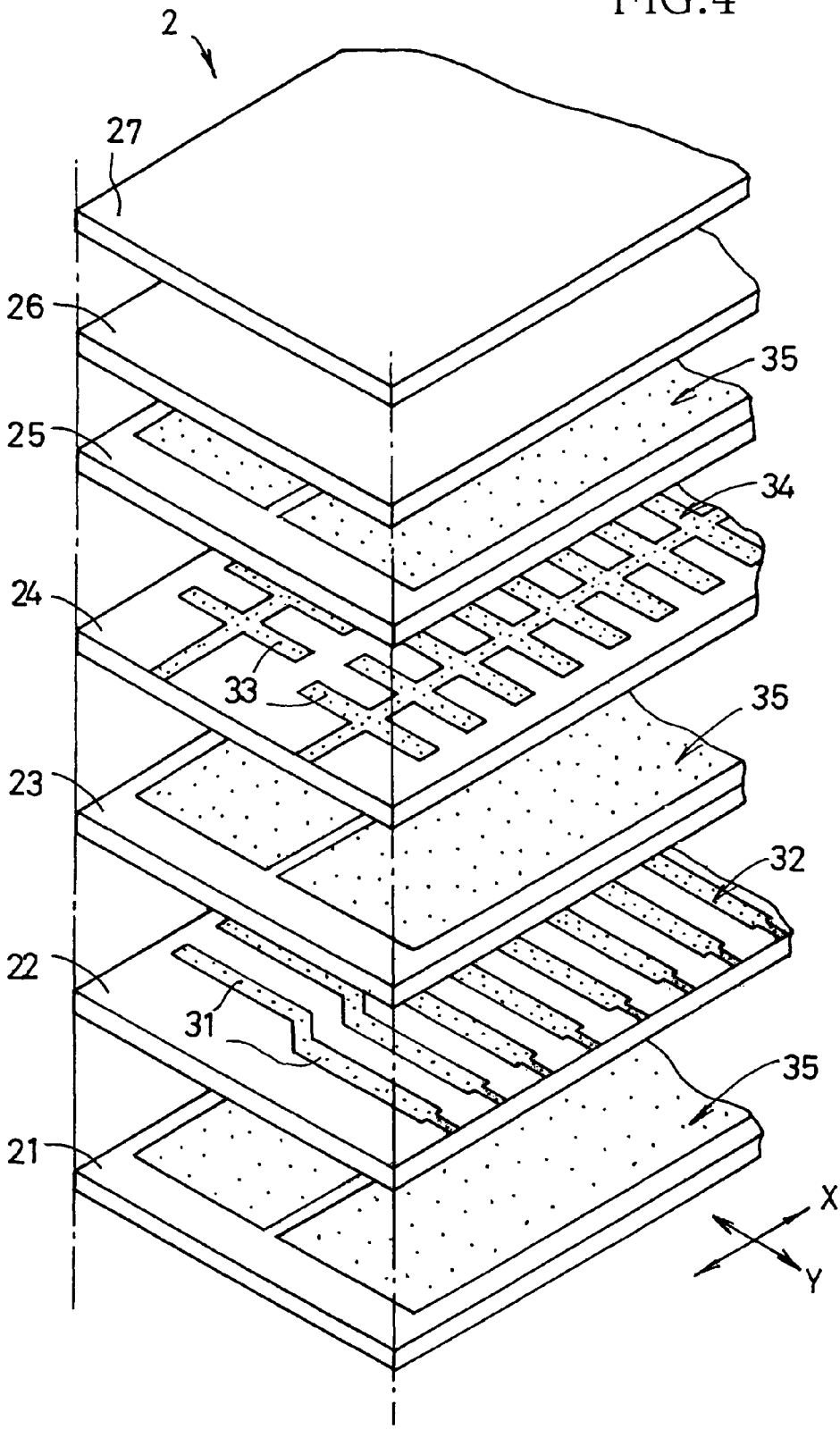
FIG. 4 is a perspective and exploded view showing a piezoelectric actuator unit of the inkjet head of FIG. 1.
Figure 5A:
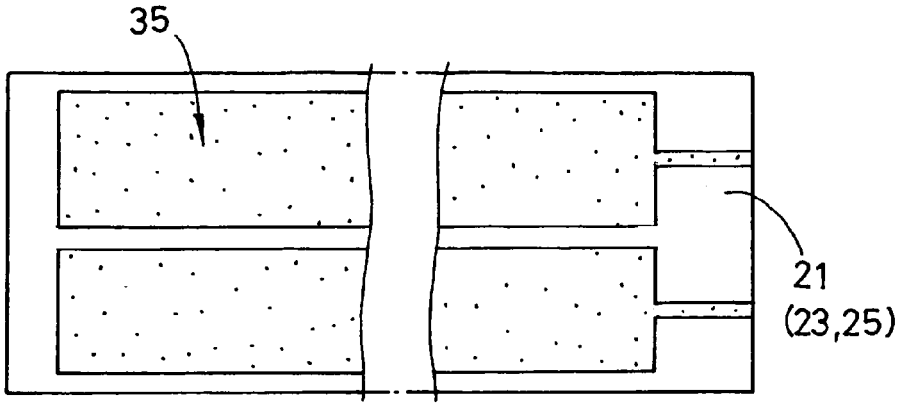
FIG. 5A is a plan view of a common-electrode layer.
Figure 5B:
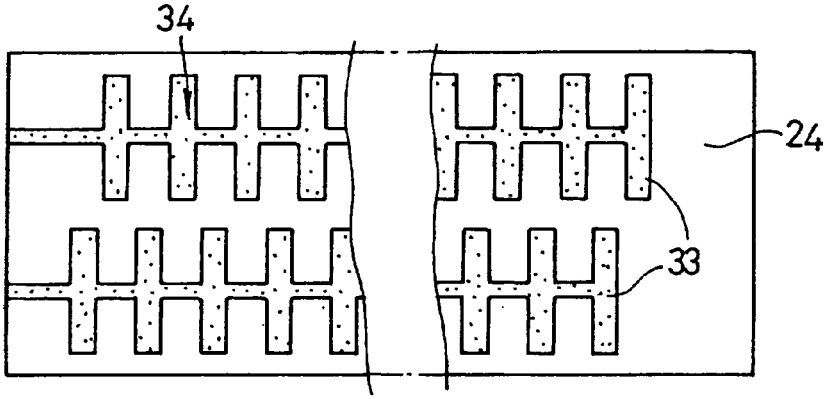
FIG. 5B is a plan view of a column-electrode layer.
Figure 5C:
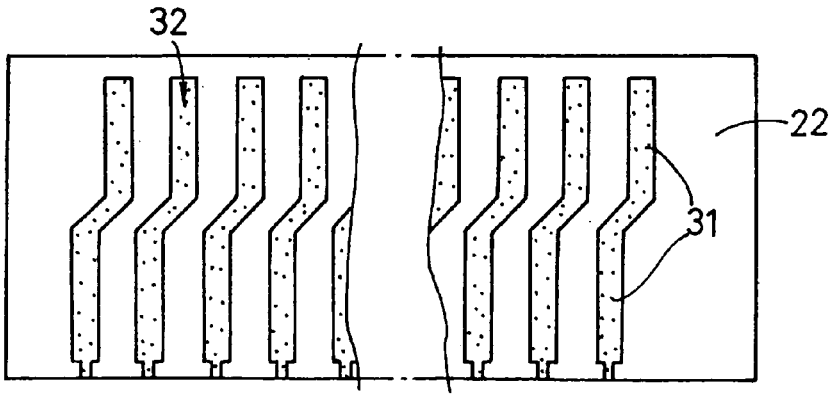
FIG. 5C is a plan view of a row-electrode layer.
Figure 6:
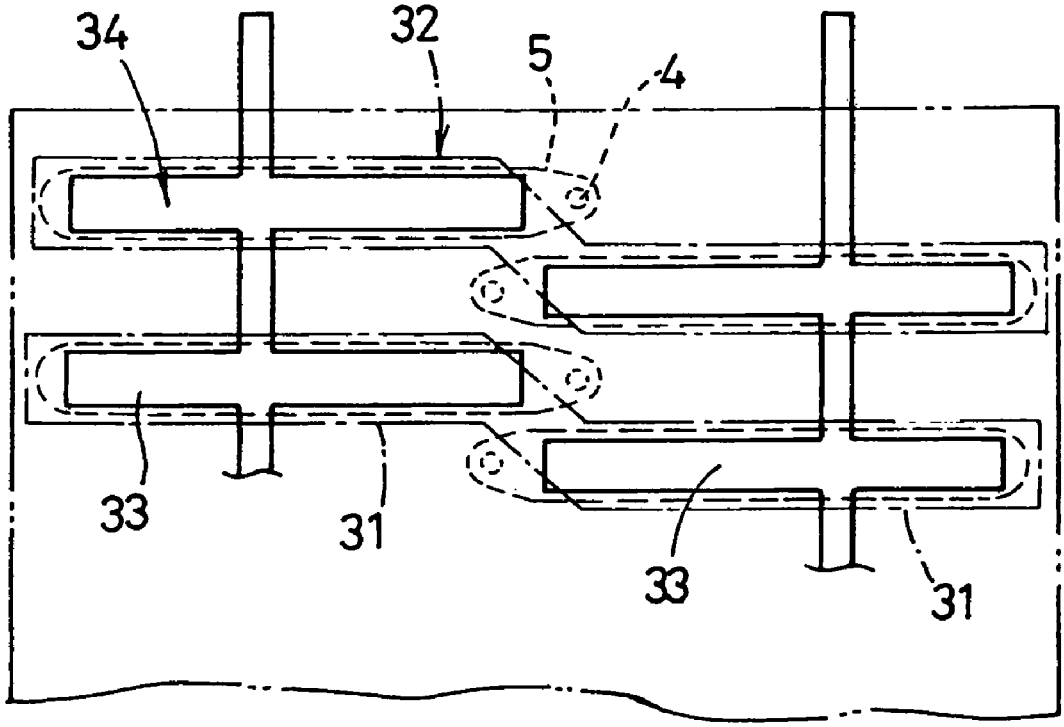
FIG. 6 is a plan view showing overlap of the electrodes with pressure chambers.
Figure 7:
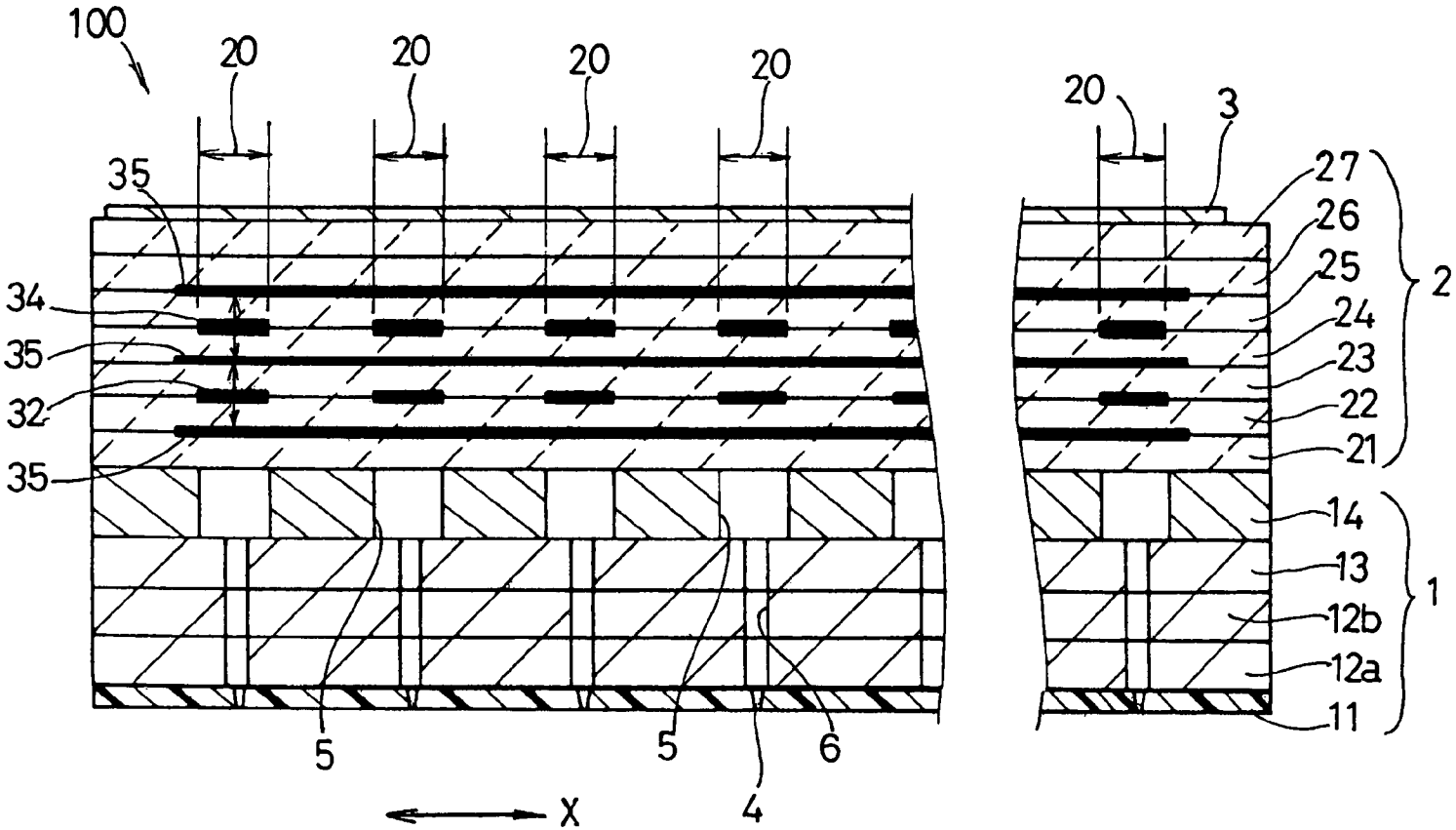
FIG. 7 is a cross sectional view taken along line 7-7 of FIG. 1.
Figure 8:
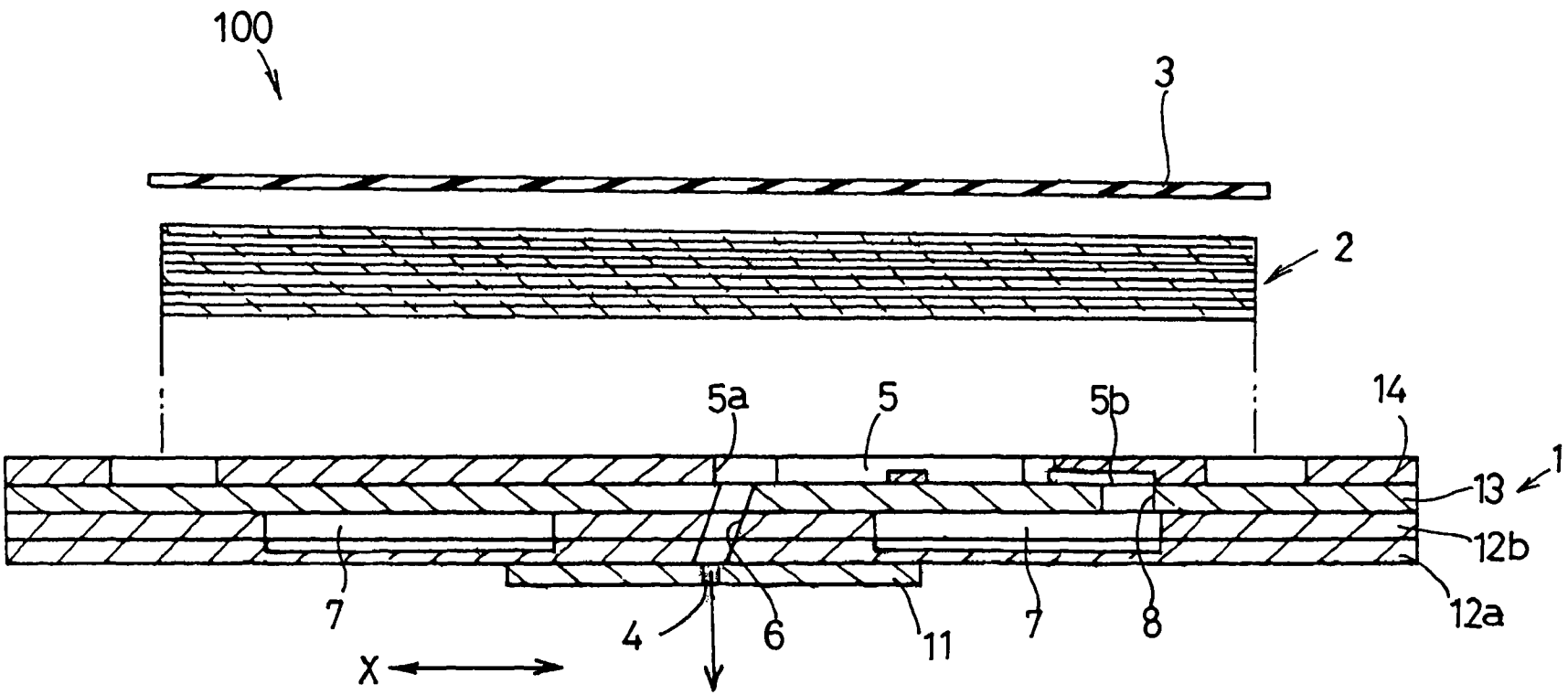
FIG. 8 is a cross sectional view taken along line 8-8 of FIG. 1.
Figure 9:
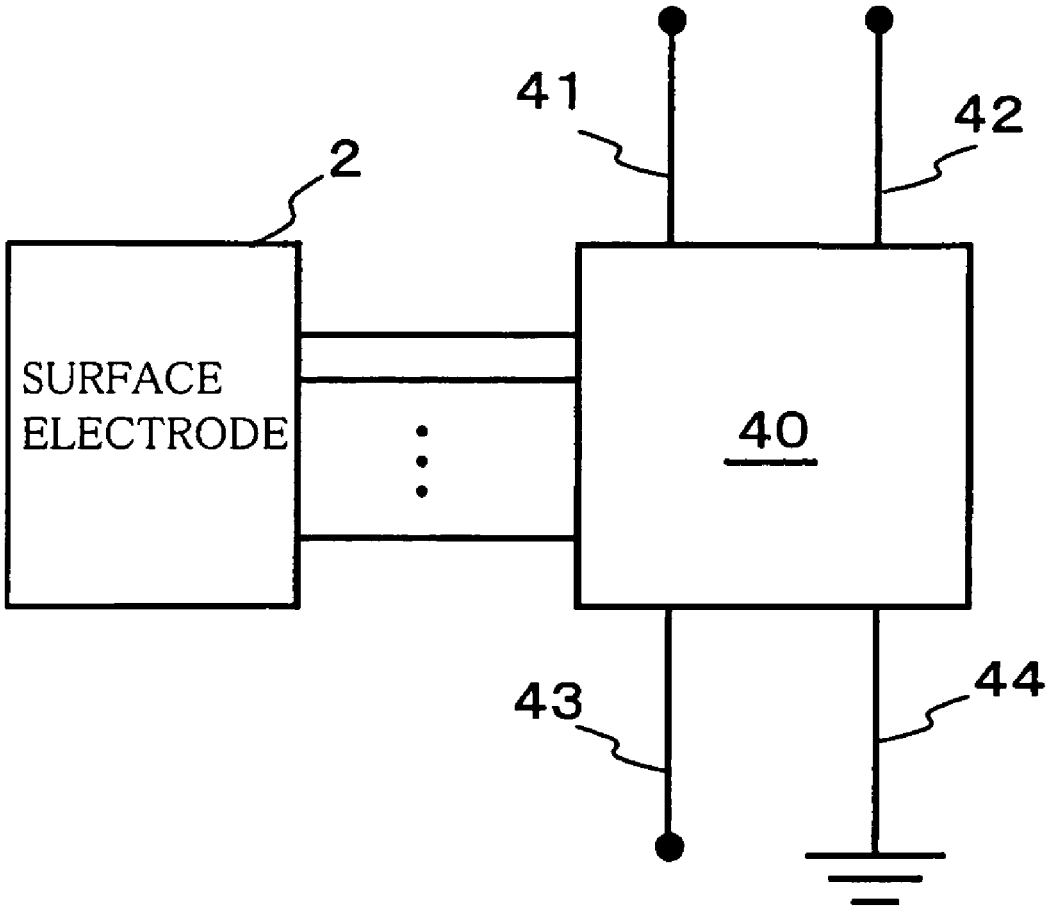
FIG. 9 is a block diagram of a controller.

Meanwhile, the piezoelectric actuator unit 2 has the plurality of actuators 20 located in respective positions aligned with the respective pressure chambers 5. Each of the actuators 20 has the electrodes and deformable portions which are arranged to be deformable to change a volume of the corresponding pressure chamber 5 that is filled with the ink. The actuator unit 2 includes a plurality of plates which are superposed on one another and integrated by firing. Each of the plates is provided by a piezoelectric body or sheet which is made of a piezoelectric material and which has an electrode pattern formed of a conductive paste applied on an upper wide face of the piezoelectric sheet. In the present first embodiment, the actuator unit 2 includes a total of seven piezoelectric layers 21-27, as shown in FIGS. 4 and 7, which are formed of piezoelectric sheets superposed on one another and fired. Among the seven piezoelectric layers 21-27, four piezoelectric layers 22, 23, 24, 25 (interposed between five electrode layers) provide the deformable portions of each actuator 20.

The actuator unit 2 includes a plurality of electrode layers in addition to the piezoelectric layers 21-27, as shown in FIG. 4. The row-electrode layer 31 as a first electrode layer is disposed on an upper face of the second lowermost one 22 of the seven piezoelectric layers 21-27, and has a plurality of row electrodes 32 as first electrodes that are electrically independent from one another. Each of the row electrodes 32 is configured to extend in the above-described second direction (Y direction) and straddle two pressure chambers 5 which are arranged in the same row and belong to the respective two different columns. The number of the row electrodes 32 is seventy five that is the same number of pressure chambers 5 which are arranged in the same column and belong to the respective seventy-five different rows (see FIGS. 5C and 6). Each of the row electrodes 32 extends up to one of widthwise opposite ends of the actuator unit 2, so as to be electrically connected to a corresponding one surface electrodes 39 that are formed on an upper face of the actuator unit 2, via a corresponding one of side electrodes 36 (see FIG. 1) that are provided on a side face of the actuator unit 2 to vertically extend. It is noted that the two pressure chambers 5 arranged in the same row correspond to pressure chambers belonging to a same one of groups which are formed by sorting in a first manner as one of at least two different manners.

The column-electrode layer 33 as a second electrode layer is disposed on an upper face of the fourth lowermost one 24 of the seven piezoelectric layers 21-27, and has a plurality of column electrodes 34 as second electrodes that are electrically independent from one another. Each of the column electrodes 34 is configured to extend in the above-described first direction (X direction) and straddle seventy-five pressure chambers 5 which are arranged in the same column and belong to the respective seventy-five different rows. The number of the column electrodes 34 is two that is the same number of pressure chambers 5 which are arranged in the same row and belong to the respective two different columns (see FIGS. 5B and 6). Each of the column electrodes 34 extends up to one of lengthwise opposite ends of the actuator unit 2, so as to be electrically connected to a corresponding one of the surface electrodes 39 that are formed on the upper face of the actuator unit 2, via a corresponding one of side electrodes 37 (see FIG. 1) that are provided on a side face of the actuator unit 2 to vertically extend. It is noted that the seventy-five pressure chambers 5 arranged in the same column correspond to pressure chambers belonging to a same one of groups which are formed by sorting in a second manner as one of at least two different manners.

The three common-electrode layers as third electrode layers are disposed on upper faces of the respective lowermost one 21, third lowermost one 23 and fifth lowermost one 25 of the seven piezoelectric layers 21-27, such that common electrodes 35 of the common-electrode layers are opposed to the row electrodes 32 and column electrodes 34. In the present embodiment, each of the three common-electrode layers has two common electrodes 35 electrically independent from each other. Each of the common electrodes 35 is configured to straddle the pressure chambers 5 arranged in the same column (see FIGS. 5A and 6). Each of the common electrodes 35 extends up to the other of the above-described lengthwise opposite ends of the actuator unit 2, so as to be electrically connected to a corresponding one of the surface electrodes 39 that are formed on the upper face of the actuator unit 2, via a corresponding one of side electrodes 38 (see FIG. 1) that are provided on a side face of the actuator unit 2 to vertically extend. The common electrodes 35 of the three common-electrode layers are electrically divided into two groups in each of which the common electrodes 35 are substantially aligned in the vertical direction. It is noted that the common electrodes 35 of the common-electrode layer may have the same configurations as those of the column electrodes 34 of the column-electrode layer 33.

As shown in FIG. 1, the surface electrodes 39 are formed on an upper surface of a seventh one (uppermost one) 27 of the seven piezoelectric layers 21-27, and are connected to the flexible flat cable 3. The surface electrodes 39 are electrically independent from one another, are connected to the seventy-five row electrodes 32, two column electrodes 34 and two common electrodes 35, respectively, so as to apply the drive voltage (supplied from the cable 3) to a selected one or ones of the row electrodes 32, column electrodes 34 and common electrodes 35.

Electric voltages higher than the drive voltages are applied to the row, column and common electrodes 32, 34, 35, such that electric fields directed from the row electrodes 32 toward the common electrodes 35 and those directed from the column electrodes 34 toward the common electrodes 35 are generated. As a result of the generation of the electric fields, each portion of the piezoelectric layers is polarized in the direction (indicated by arrows in FIG. 7) of a corresponding one of the electric fields, so as to serve the deformable portion. When the drive voltage is applied between the row and common electrodes 32, 35 such that the row electrode 32 is given a higher electric potential than the common electrode 35, an electric field directed in the same direction of the polarization is generated in each of the deformable portions of the piezoelectric layers 22, 23 interposed between the row and common electrodes 32, 35, whereby the deformable portions are caused to expand in the vertical direction, i.e., in a direction in which the piezoelectric layers are superposed on one another. When the drive voltage is applied between the row and common electrodes 32, 35 such that the row electrode 32 is given a lower electric potential than the common electrode 35, an electric field directed in the opposite direction of the polarization is generated in each of the deformable portions of the piezoelectric layers 22, 23, whereby the deformable portions are caused to contract in the vertical direction. Similarly, when the drive voltage is applied between the column and common electrodes 34, 35 such that the column electrode 34 is given a higher electric potential, the deformable portions of the piezoelectric layers 24, 25 interposed between the column and common electrodes 34, 35 are caused to expand in the vertical direction. When the drive voltage is applied between the column and common electrodes 34, 35 such that the column electrode 34 is given a lower electric potential, the deformable portions are caused to contract in the vertical direction.

Among the seven piezoelectric layers 21-27, the sixth lowermost layer 26 and seventh lowermost (uppermost) layer 27 are not subjected to the polarization treatment, so as to serve as restrictor portions that are not caused to expand and contract. Thus, with the provision of the restrictor portions above the deformable portions, the deformable portions are adapted to be displaceable or deformable downwardly toward the pressure chambers 5.

The inkjet head 100 further includes a controller operable to control a drive voltage that is to be applied to each of the row, column and common electrodes 32, 34, 35. In the present embodiment, the controller takes the form of a LSI chip 40 that is disposed on the flexible flat cable 3. The LSI chip 40 is electrically connected to the row, column and common electrodes 32, 34, 35 via the surface electrodes 39. To the LSI chip 40, there are connected a clock line 41, a data line 42, a voltage line 43 and an earth line 44. The LSI chip 40 is operable to determine, based on clock pulses supplied from the clock line 41 and data supplied from the data line 42, which one or ones of the pressure chambers 5 should be selected as pressure chamber or chambers from which the ink droplet is to be ejected. The LSI chip 40 controls the actuators 20 corresponding to the selected pressure chambers 5 and also those corresponding to non-selected pressure chambers 5, by controlling the drive voltage that is to be applied to each of the electrodes 32, 34, 35. That is, the LSI chip 40 selectively applies the drive voltage (supplied from the voltage line 43) to the electrodes 32, 34, 35 of each actuator 20, and connects electrode 32, 34, 35 of each actuator 20 to the earth line 44, depending upon necessity of ejection of the ink droplet from the corresponding pressure chamber 5.

Figure 10B:
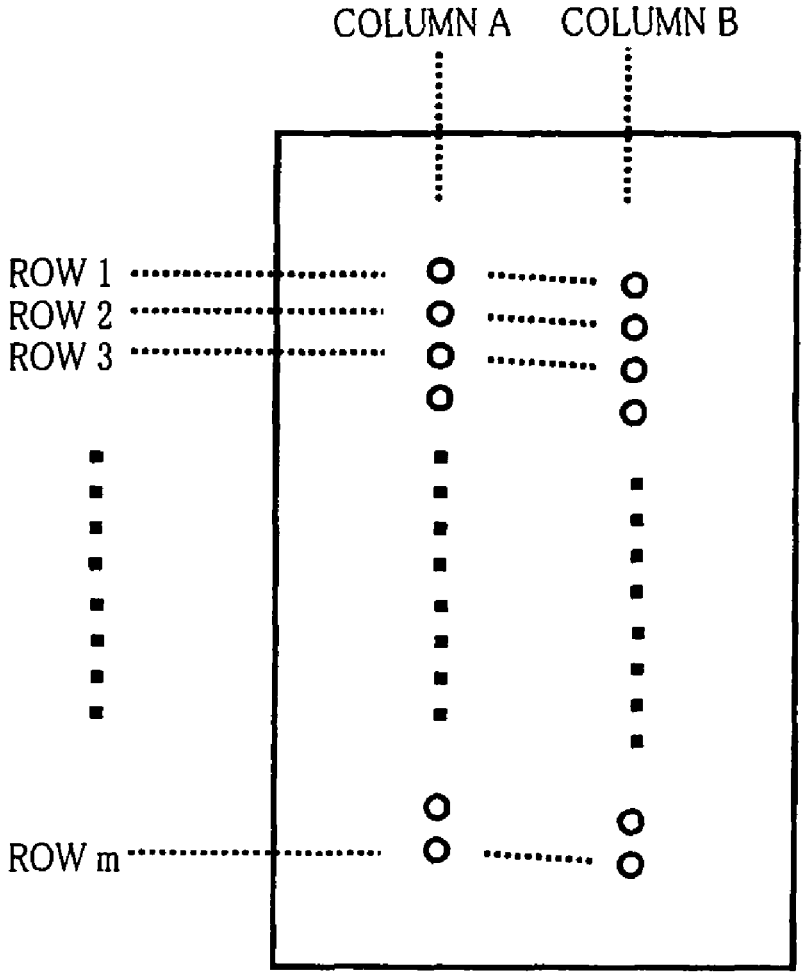
FIG. 10B is a view showing nozzles arranged in a matrix including a plurality of rows and columns.

Referring next to FIGS. 10A and 10B, there will be described a method of driving the inkjet head 100 constructed according to the first embodiment. FIG. 10B is a view for indicating denominations given to the rows and columns of the nozzles 4, pressure chambers 5 and actuators 20. As indicated in FIG. 10B, the rows are denominated as "ROW 1", "ROW 2", "ROW 3", . . . , "ROW m", while the columns are denominated as "COLUMN A" and "COLUMN B". FIG. 10A shows, by way of example, operations of the actuators 20 of "ROW 1, COLUMN A", "ROW 2, COLUMN A", "ROW 1, COLUMN B" and "ROW 2, COLUMN B", namely, a relationship between a combination of the drive voltages applied to the electrodes of each actuator 20 and an amount of displacements or deformations of the deformable portions of each actuator 20, in a case where the ink droplet is to be ejected from only the pressure chamber 5 (nozzle 4) of "ROW 1, COLUMN A" while the ink droplet is not to be ejected from the other pressure chambers 5 (nozzles 4) of "ROW 2, COLUMN A", "ROW 1, COLUMN B" and "ROW 2, COLUMN B".

A ratio of the drive voltage applicable to each of the row electrodes 32, the drive voltage applicable to each of the column electrodes 34 and the drive voltage applicable to each of the common electrodes 35 is fixed. In the example shown in FIG. 10A, the ratio is 2:1:1, so that the drive voltage applicable to each row electrode 32 is higher than that applicable to each column electrode 34 and that applicable to each common electrode 35. This ratio 2:1:1 is merely an example, and may be changed as needed. In FIG. 10A, the drive voltage applicable to each column electrode 34 and that applicable to each common electrode 35 are represented by "+V" and "+V", respectively, while the drive voltage applicable to each row electrode 32 is represented by "+2V". The amount of displacement or deformation of the deformable portion interposed between the electrodes, which is caused as a result of control of the voltages applied to the electrodes, is represented by a combination of sign ("+", "−") and absolute value. The sign "+" represents an expansion of the deformable portion in the vertical direction, i.e., in the direction in which the layers are superposed on one another. The sign "−" represents a contraction of the deformable portion in the vertical direction. The absolute value "2" represents an amount of the deformation of the deformable portion caused by an electric potential difference of "2V" between the electrodes. The absolute value "1" represents an amount of the deformation of the deformable portion caused by an electric potential difference of "V" between the electrodes. The absolute value "0" means that the deformable portion is not deformed. That is, where the amount of deformation is represented by "+2", it means that the deformable portion is caused to expand in the vertical direction by an amount based on the potential difference of "2V". Where the amount of deformation is represented by "−1", it means that the deformable portion is caused to contract in the vertical direction by an amount based on the potential difference of "V". The inkjet head 100 is arranged such that the ink droplet is ejected from the corresponding pressure chamber 5 where a sum of amounts of deformations of the deformable portions exceeds "+5" as a threshold.

In the present embodiment, the application of the drive voltages to the respective column electrodes 34 are made at different points of time. This arrangement is effective, where the ink droplet is to be ejected from one of the pressure chambers 5 arranged in the same row while the ink droplet is not to be ejected from the other of the pressure chambers 5 arranged in the same row, to prevent undesirable ejection of the ink droplet from the other pressure chamber 5, due to influence of application of the drive voltage to the electrode corresponding to the above-described one of the pressure chambers 5.

Where the ink droplet is to be ejected from the pressure chamber 5 of "ROW 1, COLUMN A", the drive voltages "+2V", "+V" and "0V" are respectively applied to the row, column and common electrodes 32, 34, 35 corresponding to the pressure chamber 5 of "ROW 1, COLUMN A", as shown in FIG. 10A. The corresponding common electrode 35 is connected to the earth line 44. As a result of the applications of the drive voltages, one of the actuators 20 corresponding to the pressure chamber 5 of "ROW 1, COLUMN A" is caused to expand toward this pressure chamber 5. Described specifically, in the actuator 20 corresponding to the pressure chamber 5 of "ROW 1, COLUMN A", each of the deformable portions (hereinafter referred to as first deformable portions) provided by the respective second and third lowermost piezoelectric layers 22, 23 interposed between the row and common electrodes 32, 35 is displaced or deformed by an amount of "+2", since an electric potential given to the row electrode 32 is higher than that given to the common electrode 35 by "2V". Each of the deformable portions (hereinafter referred to as second deformable portions) provided by the respective fourth and fifth lowermost piezoelectric layers 24, 25 interposed between the column and common electrodes 34, 35 is displaced or deformed by an amount of "+1", since an electric potential given to the column electrode 34 is higher than that given to the common electrode 35 by "V". Thus, the sum of the deformations of the first and second deformable portions of the actuator 20 corresponding to the pressure chamber 5 of "ROW 1, COLUMN A", i.e., the deformation of the entirety of this actuator 20 amounts to "+6", which is larger than "+5" as a minimum amount required to cause the ink droplet to be ejected from the pressure chamber 5.

The row electrode 32 corresponding to the pressure chamber 5 of "ROW 1, COLUMN A" corresponds also to the pressure chamber 5 of "ROW 1, COLUMN B", since this row electrode 32 is configured to straddle these two pressure chambers 5. That is, the drive voltage "+2V" is applied to the row electrode 32 corresponding to the pressure chamber 5 of "ROW 1, COLUMN B". Meanwhile, the drive voltage "+1V" is applied to the common electrode 35 corresponding to the pressure chamber 5 of "ROW 1, COLUMN B". Thus, in the actuator 20 corresponding to the pressure chamber 5 of "ROW 1, COLUMN B", each of the first deformable portions provided by the respective second and third lowermost piezoelectric layers 22, 23 interposed between the row and common electrodes 32, 35 is displaced or deformed by an amount of "+1" (which is smaller than the deformation amount of each of the first deformable portions of the actuator 20 corresponding to pressure chamber 5 of "ROW 1, COLUMN A"), since an electric potential given to the row electrode 32 is higher than that given to the common electrode 35 by "V". Each of the second deformable portions provided by the respective fourth and fifth lowermost piezoelectric layers 24, 25 interposed between the column and common electrodes 34, 35 is displaced or deformed by an amount of "−1", namely, is caused to contract rather than to expand, since an electric potential given to the column electrode 34 is lower than that given to the common electrode 35 by "V", namely, since an electric field directed in a direction opposite to the direction of the polarization is generated in each of the second deformable portions. Thus, the sum of the deformations of the first and second deformable portions of the actuator 20 corresponding to the pressure chamber 5 of "ROW 1, COLUMN B", i.e., the deformation of the entirety of this actuator 20 amounts to "0", which is smaller than "+5" as the minimum amount required to cause the ink droplet to be ejected from the pressure chamber 5.

The column and common electrodes 34, 35 corresponding to the pressure chamber 5 of "ROW 1, COLUMN A" correspond also to the pressure chamber 5 of "ROW 2, COLUMN A", since these column and common electrodes 34, 35 are configured to straddle all of the pressure chambers 5 arranged in the "COLUMN A". That is, the drive voltage "+V" is applied to the column electrode 34 corresponding to the pressure chamber 5 of "ROW 2, COLUMN A". Meanwhile, the drive voltage "0V" is applied to the row electrode 32 corresponding to the pressure chamber 5 of "ROW 2, COLUMN A", by connecting this row electrode 32 to the earth line. Thus, in the actuator 20 corresponding to the pressure chamber 5 of "ROW 2, COLUMN A", each of the first deformable portions provided by the respective second and third lowermost piezoelectric layers 22, 23 interposed between the row and common electrodes 32, 35 is displaced or deformed by an amount of "0", while each of the second deformable portions provided by the respective fourth and fifth lowermost piezoelectric layers 24, 25 interposed between the column and common electrodes 34, 35 is displaced or deformed by an amount of "+1", namely, is caused to expand. Thus, the sum of the deformations of the first and second deformable portions of the actuator 20 corresponding to the pressure chamber 5 of "ROW 2, COLUMN A", i.e., the deformation of the entirety of this actuator 20 amounts to "+2", which is smaller than "+5" as the minimum amount required to cause the ink droplet to be ejected from the pressure chamber 5.

The column and common electrodes 34, 35 corresponding to the pressure chamber 5 of "ROW 1, COLUMN B" correspond also to the pressure chamber 5 of "ROW 2, COLUMN B", since these column and common electrodes 34, 35 are configured to straddle all of the pressure chambers 5 arranged in the "COLUMN B". Further, the row electrode 32 corresponding to the pressure chamber 5 of "ROW 2, COLUMN A" corresponds also to the pressure chamber 5 of "ROW 2, COLUMN B", since this row electrode 32 is configured to straddle these two pressure chambers 5. Thus, the drive voltages "0V", "0V", "+V" are applied to the row, column and common electrodes 32, 34, 35 corresponding to the pressure chamber 5 of "ROW 2, COLUMN B", respectively. Consequently, in the actuator 20 corresponding to the pressure chamber 5 of "ROW 2, COLUMN B", each of the first and second deformable portions provided by the respective piezoelectric layers 22, 23, 24, 25 is caused to contract rather than to expand, since an electric field directed in a direction opposite to the direction of the polarization is generated in each of the first and second deformable portions. Thus, the sum of the deformations of the first and second deformable portions of the actuator 20 corresponding to the pressure chamber 5 of "ROW 2, COLUMN B", i.e., the deformation of the entirety of that actuator 20 amounts to "−4", which is smaller than "+5" as the minimum amount required to cause the ink droplet to be ejected from the pressure chamber 5.

As is apparent from the above description, the ink droplet can be ejected through a selected one or ones of the nozzles 4, by controlling the drive voltages applied to the row, column and common electrodes 32, 34, 35. While FIG. 10A shows the case where the ink droplet is ejected from only the pressure chamber 5 of "ROW 1, COLUMN A", the ink droplet can be ejected from the other of the pressure chambers 5 of the "COLUMN A", by controlling the drive voltages applied to the corresponding electrodes 32, 34, 35 in the same manner as in the control of the drive voltages applied to the electrodes 32, 34, 35 corresponding to the pressure chamber 5 of "ROW 1, COLUMN A". Further, for not causing the ink droplet from being ejected from the other pressure chambers 5 of the "COLUMN A", the drive voltages applied to the corresponding electrodes 32, 34, 35 may be controlled in the same manner as in the control of the drive voltages applied to the electrodes 32, 34, 35 corresponding to the pressure chamber 5 of "ROW 2, COLUMN A". Further, in a case where the ink droplet is ejected from only the pressure chamber 5 of "ROW 1, COLUMN B", the drive voltages applied to the electrodes 32, 34, 35 corresponding to the pressure chambers 5 of the "COLUMN A" may be controlled in the same manner as in the control of the drive voltages applied to the electrodes 32, 34, 35 corresponding to the pressure chambers 5 of "COLUMN B" in the above-described case shown in FIG. 10A, while the drive voltages applied to the electrodes 32, 34, 35 corresponding to the pressure chambers 5 of the "COLUMN B" may be controlled in the same manner as in the control of the drive voltages applied to the electrodes 32, 34, 35 corresponding to the pressure chambers 5 of "COLUMN A" in the above-described case shown in FIG. 10A.

In the above-described embodiment, the actuator 20 corresponding to the selected pressure chamber 5 (from which the ink droplet is to be ejected) is caused to expand toward the selected pressure chamber 5, so as to enable the ink droplet to be ejected from the selected pressure chamber 5. However, it is possible to employ a modified arrangement in which all the actuators 20 corresponding to the respective pressure chambers 5 are kept to expand toward the pressure chambers 5, and the actuator 20 corresponding to the selected pressure chamber 5 (from which the ink droplet is to be ejected) is caused, in response to a command requesting the ejection of the ink droplet from the selected pressure chamber 5, to once contract to increase the volume of the selected pressure chamber 5 and then to expand again toward the pressure chamber 5. In this modified arrangement, too, the drive voltages are applied to the electrodes, with the above-described ratio of the drive voltages applicable to each row electrode 32, each column electrode 34 and each common electrode 35.

In the above-described embodiment, the actuator unit 2 includes a set of lamination structure consisting of the five electrode layers and the four piezoelectric layers which are interposed between the five electrode layers. However, the actuator unit 2 may include a plurality of sets of lamination structures each consisting of the five electrode layers and the four piezoelectric layers, such that the plurality of sets of lamination structures are superposed on each other in a direction of lamination of the layers. In this modified arrangement, the sum of deformations of the deformable portions in the lamination direction can be further increased.

In the above-described embodiment, the number of outputs that are required to be supplied from the controller is (m+n+n), i.e., a total of the number (m) of the row electrodes 32, the number (n) of the column electrodes 34 and the number (n) of the common electrodes 35. Where m=75, n=2, the required number of outputs will be 79 that is remarkably smaller than 150, which is the number of outputs that are required in a conventional droplet ejection device with the arrangement of the same number of nozzles. That is, in the above-described embodiment, the controller circuit can be simplified and accordingly constructed at a reduced cost.

Further, in the above-described embodiment, where the number of columns of nozzles is doubled to four (m=75, n=4) thereby doubling the total number of nozzles, the required number of outputs to be supplied from the controller would be 83. That is, even where the number of nozzles is considerably increased, the required number of outputs is not so increased. This means that, even where the number of nozzles is increased for attending a need for recording or printing a higher density of full-color image at a higher speed, it is possible to restrain an increase in cost required for the controller circuit.

Further, since the number of outputs required in the controller circuit is made small, it is possible to reduce the density of the output lines arranged in the flexible flat cable 3, thereby eliminating necessity of employ an extremely thin line as each of the output lines.

Further, in the above-described embodiment, each of the actuators 20 corresponding to one of the pressure chambers 5 includes the first deformable portions interposed between the row and common electrodes 32, 35 and the second deformable portions interposed between the column and common electrodes 34, 35. Each actuator 20 can be controlled such that each first deformable portion and each second deformable portion are different from each other with respect to the amount and direction of the deformation. Therefore, in spite of absence of individual electrodes corresponding to the respective pressure chambers 5 and electrically independent from each other, the volumes of the respective pressure chambers 5 can be changed differently from each other, by controlling a combination of the deformation of each first deformable portion and the deformation of each second deformable portion.

Due to the absence of individual electrodes corresponding to the respective pressure chambers 5 and electrically independent from each other, there would be a case where the drive voltage is applied also to the electrode corresponding to the non-selected pressure chamber 5 (from which the ink droplet is not to be ejected) as a result of application of the drive voltage to the electrode corresponding to the selected pressure chamber 5 (from which the ink droplet is to be ejected). However, in the present embodiment, it is possible to inhibit the ejection of the ink droplet from the non-selected pressure chamber 5, by controlling the sum of the deformations of the deformable portions of the actuator 20 corresponding to the non-selected chamber 5 such that the sum does not exceed the threshold.

In the above-described embodiment, the deformation of the deformable portions provided by the piezoelectric layers 22, 23 can be controlled by controlling the electric potential difference between the row and common electrodes 32, 35, while the deformation of the deformable portions provided by the piezoelectric layers 24, 25 can be controlled by controlling the electric potential difference between the column and common electrodes 34, 35.

In the above-described embodiment, the controller provided by the LSI chip 40 includes a selective-ejection controlling portion operable to allow the ejection of the ink droplet from the selected pressure chambers 5 belonging to a same one of the groups formed by sorting in the above-described first manner, while inhibiting the ejection of the ink droplet from the non-selected pressure chamber 5 belonging to the same group. The selective-ejection controlling portion establishes, between at least one of the common electrodes 35 and one of the row electrodes 32 that straddles the pressure chambers 5 belonging to the same group (same row), an electric potential difference causing the first deformable portions corresponding to the respective pressure chambers 5, to be deformed in a first direction (in a direction toward the pressure chambers 5). Meanwhile, the selective-ejection controlling portion establishes, between at least one of the common electrodes 35 and one of the column electrodes 34 that corresponds to the non-selected pressure chamber 5, an electric potential difference causing the second deformable portion corresponding to the non-selected pressure chamber 5, to be deformed in a second direction that is opposite to the first direction.

The selective-ejection controlling portion of the controller establishes, between the row electrode 32 and one of the common electrodes 35 corresponding to the selected pressure chamber 5, an electric potential difference causing the first deformable portion corresponding to the selected pressure chamber 5, to be deformed in the above-described first direction by a relatively large amount. Meanwhile, the selective-ejection controlling portion establishes, between the row electrode 32 and one of the common electrodes 35 corresponding to the non-selected pressure chamber 5, an electric potential difference causing the first deformable portion corresponding to the non-selected pressure chamber 5, to be deformed in the first direction by a relatively small amount that is smaller than the relatively large amount.

In the above-described embodiment, the ratio of the electric voltage applicable to each row electrode 32, that applicable to each column electrode 34 and that applicable to each common electrode 35 is substantially fixed, so that distribution of the electric voltages to the electrodes 32, 34, 35 is easily made upon determination of the electric voltages to be applied to the electrodes 32, 34, 35.

In the above-described embodiment, the electric voltage applicable to each of the column and common electrodes 34, 35 is lower than that applicable to each of the row electrodes 32, so that an electric potential difference between the row and common electrodes 32, 35 can be made larger than that between the column and common electrodes 34, 35, namely, so that the deformation amount of the first deformable portion provided by each piezoelectric layer can be made larger than that of the second deformable portion provided by each piezoelectric layer.

In the above-described embodiment, the electric voltage is applied to a selected one or ones of the electrodes 32, 34, 35, while the application of the electric voltage to a non-selected one or ones of the electrodes 32, 34, 35 is suspended, so that the deformations of the respective deformable portions of the actuators 20 can be controlled.

Referring to FIGS. 11A-11C, there will be described some specified arrangements for controlling the application of the drive voltages, by way of examples. FIGS. 11A-11C are tables showing results of calculations made by assuming a case where the same control as shown in FIG. 10A is carried out in the inkjet head 100 using piezoelectric layers each of which is displaced or deformed by 0.25 nm with a potential difference of 1V between the electrodes between which the piezoelectric layer is interposed.

In Example 1 shown in FIG. 11A, the ratio of the drive voltages applicable to the respective row, column and common electrodes 32, 34, 35 is 2:1:1, as in the above-described case of FIG. 10A. Specifically, in this Example 1 of FIG. 11A, the drive voltages applicable to the respective row, column and common electrodes 32, 34, 35 are 20.00V, 10.00V and 10.00V, respectively. In this Example 1 with the control of the application of the drive voltages in the same manner as in the case of FIG. 10A, it was confirmed that the deformation amount of the entirety of the actuator 20 corresponding to the pressure chamber 5 of "ROW 1, COLUMN A" (from which the ink droplet is to be ejected) was 15.00 nm, while the deformation amount of the entirety of each of the other actuators 20 (from which the ink droplet is not to be ejected) was smaller than a minimum amount (10.25 nm) required to cause the ink droplet to be ejected from the pressure chamber 5.

In Example 2 shown in FIG. 11B, the ratio of the drive voltages applicable to the respective row, column and common electrodes 32, 34, 35 is 4:2:1, unlike in the above-described case of FIG. 10A. Specifically, in this Example 2 of FIG. 11B, the drive voltages applicable to the respective row, column and common electrodes 32, 34, 35 are 20.00V, 10.00V and 5.00V, respectively. In this Example 2 with the control of the application of the drive voltages in the same manner as in the case of FIG. 10A, it was confirmed that the deformation amount of the entirety of the actuator 20 corresponding to the pressure chamber 5 of "ROW 1, COLUMN A" (from which the ink droplet is to be ejected) was 15.00 nm, while the deformation amount of the entirety of each of the other actuators 20 (from which the ink droplet is not to be ejected) was smaller than the minimum amount required to cause the ink droplet to be ejected from the pressure chamber 5.

Example 3 shown in FIG. 11C is an example which is different from the case of FIG. 10A, with respect to the control of application of the drive voltages to the common electrodes 35. In this Example 3, each common electrode (upper common electrode) 35 of the common electrode layer disposed on the upper surface of the lowermost piezoelectric layer 21, each common electrode (middle common electrode) 35 of the common electrode layer disposed on the upper surface of the third lowermost piezoelectric layer 23, and each common electrode (lower common electrode) 35 of the common electrode layer disposed on the upper surface of the fifth lowermost piezoelectric layer 25 are electrically independent from one another, so that different drive voltages can be applied to the upper, middle and lower common electrodes 35, independently of each other. A ratio of the drive voltages applicable to the respective row, column, upper common, middle common and lower common electrodes 32, 34, 35, 35, 35 is 4:2:2:1.5:−1. Specifically, the drive voltages applicable to the respective row, column, upper common, middle common and lower common electrodes 32, 34, 35, 35, 35 are 20.00V, 10.00V, 10.00V, 7.50V and −5.00V, respectively. In this Example 3 with the control of the application of the drive voltages in the same manner as in the case of FIG. 10A, it was confirmed that the deformation amount of the entirety of the actuator 20 corresponding to the pressure chamber 5 of "ROW 1, COLUMN A" (from which the ink droplet is to be ejected) was 15.00 nm, while the deformation amount of the entirety of each of the other actuators 20 (from which the ink droplet is not to be ejected) was smaller than the minimum amount required to cause the ink droplet to be ejected from the pressure chamber 5.

Figure 12:
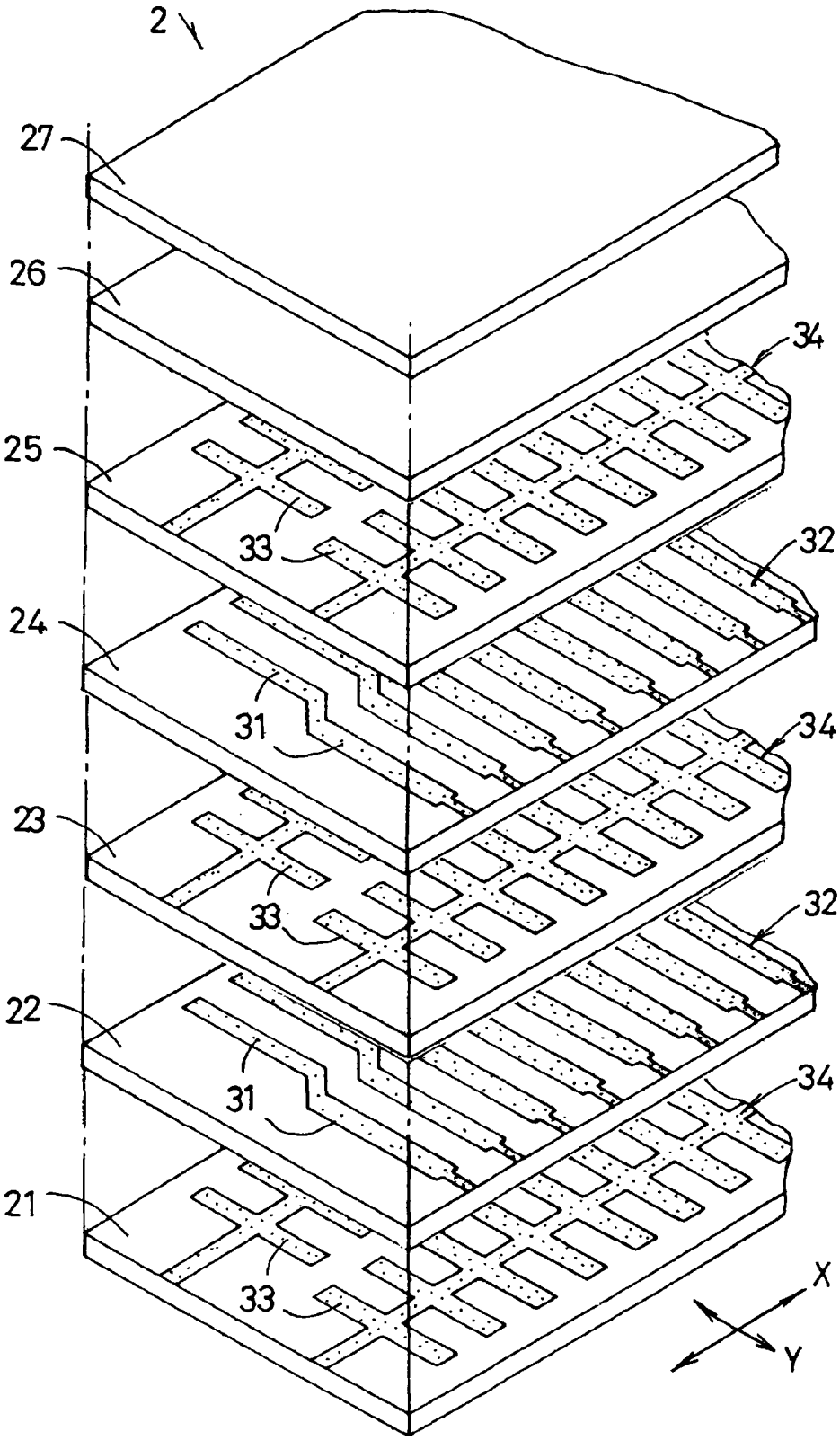
FIG. 12 is a perspective and exploded view showing a piezoelectric actuator unit of an inkjet head constructed according to a second embodiment of the invention.
Figure 13:
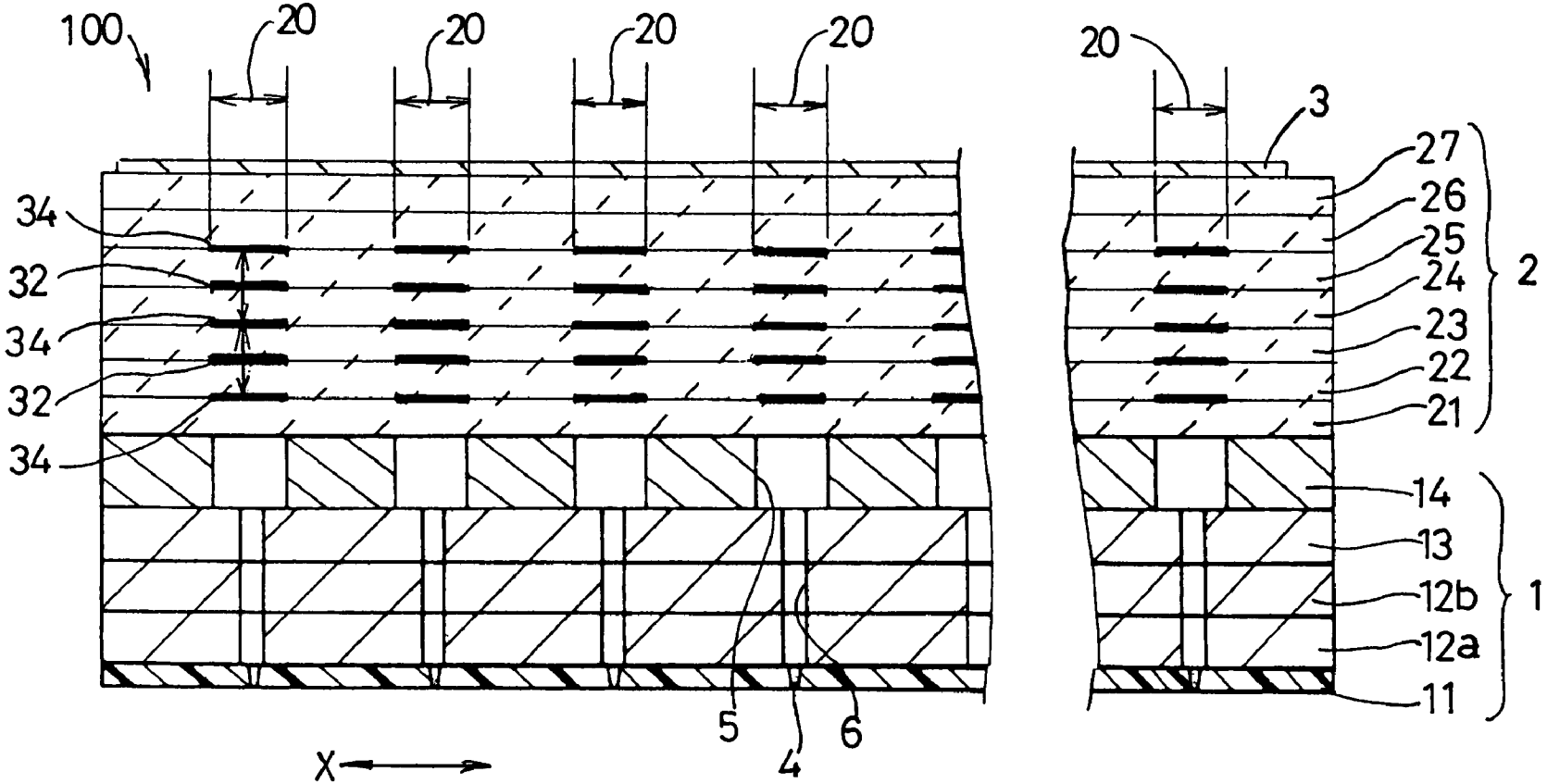
FIG. 13 is a cross sectional view corresponding to FIG. 7, and showing the inkjet head of FIG. 12.

Referring next to FIGS. 12-14, there will be described an inkjet head constructed according to a second embodiment of the invention. The same reference numerals as used in the first embodiment will be used to identify the same or similar elements, and redundant description of these elements will not be provided.

In the above-describe first embodiment, the actuator unit 2 includes three kinds of electrodes, i.e., the row electrodes 32 as the first electrodes, the column electrodes 34 as the second electrodes and the common electrodes 35 as the third electrodes. In this second embodiment, the actuator unit 2 includes two kinds of electrodes, i.e., the row electrodes 32 as the first electrodes and the column electrodes 34 as the second electrodes, and does not include the common electrodes 35 as the third electrodes. Specifically described, as shown in FIG. 12, the actuator unit 2 includes seven piezoelectric layers 21-27, three column-electrode layers 33 which are disposed on uppers surfaces of the respective first, third and fifth lowermost piezoelectric layers 21, 23, 25 and which have the column electrodes 34, and two row-electrode layers 31 which are disposed on uppers surfaces of the respective second and fourth lowermost piezoelectric layers 22, 24 and which have the row electrodes 32. Like in the above-described first embodiment, the surface electrodes (not shown) are disposed on an upper surface of the seventh lowermost (uppermost) piezoelectric layer 27, and are connected to the respective electrodes 34, 32. The sixth lowermost layer 26 and seventh lowermost (uppermost) layer 27 serve as restrictor portions that are not caused to expand and contract. With application of the electric voltages, each row electrode 32 is given an electric potential higher than each column electrode 34, whereby each of the deformable portions of the piezoelectric layers 22-25 is polarized in a direction away from the row electrode 32 toward the column electrode 34, as indicated by arrows in FIG. 13, so that the each of the deformable portions can expand and contract in the lamination direction.

There will be described a method of driving the inkjet head constructed according to the second embodiment, with reference to FIG. 14. The rows and columns of the nozzles 4, pressure chambers 5 and actuators 20 are given the same denominations as in FIG. 10B. FIG. 14 shows, by way of example, operations of the actuators 20 of "ROW 1, COLUMN A", "ROW 2, COLUMN A", "ROW 1, COLUMN B" and "ROW 2, COLUMN B", namely, a relationship between a combination of the drive voltages applied to the electrodes of each actuator 20 and an amount of displacements or deformations of the deformable portions of each actuator 20, in a case where the ink droplet is to be ejected from only the pressure chamber 5 (nozzle 4) of "ROW 1, COLUMN A" while the ink droplet is not to be ejected from the other pressure chambers 5 (nozzles 4) of "ROW 2, COLUMN A", "ROW 1, COLUMN B" and "ROW 2, COLUMN B". The ink droplet is ejected from the corresponding pressure chamber 5, where a sum of amounts of deformations of the deformable portions exceeds "+5" as a threshold.

For causing the ink droplet to be ejected from the pressure chamber 5 of "ROW 1, COLUMN A", the drive voltages "V" and "−V" are respectively applied to the row and column electrodes 32, 34 corresponding to the pressure chamber 5 of "ROW 1, COLUMN A". As a result of the applications of the drive voltages, one of the actuators 20 corresponding to the pressure chamber 5 of "ROW 1, COLUMN A" is caused to expand toward this pressure chamber 5. Described specifically, in the actuator 20 corresponding to the pressure chamber 5 of "ROW 1, COLUMN A", each of the deformable portions provided by the respective second, third, fourth and fifth lowermost piezoelectric layers 22-25 is displaced or deformed by an amount of "+2", since the electric potential given to the row electrode 32 is higher than that given to the column electrode 34 by "2V", namely, since an electric field directed in the same direction of the polarization is generated in each of the deformable portions of the piezoelectric layers 22-25. Thus, the sum of the deformations of the deformable portions of the actuator 20 corresponding to the pressure chamber 5 of "ROW 1, COLUMN A" amounts to "+6", which is larger than "+5" as a minimum amount required to cause the ink droplet to be ejected from the pressure chamber 5.

The row electrode 32 corresponding to the pressure chamber 5 of "ROW 1, COLUMN A" corresponds also to the pressure chamber 5 of "ROW 1, COLUMN B", since this row electrode 32 is configured to straddle these two pressure chambers 5. That is, the drive voltage "+V" is applied to the row electrode 32 corresponding to the pressure chamber 5 of "ROW 1, COLUMN B". Meanwhile, the drive voltage "0V" is applied to the column electrode 34 corresponding to the pressure chamber 5 of "ROW 1, COLUMN B". Thus, in the actuator 20 corresponding to the pressure chamber 5 of "ROW 1, COLUMN B", each of the deformable portions is displaced or deformed by an amount of "+1" (which is smaller than the deformation amount of each of the deformable portions of the actuator 20 corresponding to pressure chamber 5 of "ROW 1, COLUMN A"). Thus, the sum of the deformations of the deformable portions of the actuator 20 corresponding to the pressure chamber 5 of "ROW 1, COLUMN B" amounts to "+4", which is smaller than "+5" as the minimum amount required to cause the ink droplet to be ejected from the pressure chamber 5.

The column electrode 34 corresponding to the pressure chamber 5 of "ROW 1, COLUMN A" corresponds also to the pressure chamber 5 of "ROW 2, COLUMN A", since this column electrode 34 is configured to straddle all of the pressure chambers 5 arranged in the "COLUMN A". That is, the drive voltage "−V" is applied to the column electrode 34 corresponding to the pressure chamber 5 of "ROW 2, COLUMN A". Meanwhile, the drive voltage "0V" is applied to the row electrode 32 corresponding to the pressure chamber 5 of "ROW 2, COLUMN A". Thus, in the actuator 20 corresponding to the pressure chamber 5 of "ROW 2, COLUMN A", each of the deformable portions provided by the piezoelectric layers 22-25 is displaced or deformed by an amount of "+1". Consequently, the sum of the deformations of the deformable portions of the actuator 20 corresponding to the pressure chamber 5 of "ROW 2, COLUMN A" amounts to "+4", which is smaller than "+5" as the minimum amount required to cause the ink droplet to be ejected from the pressure chamber 5.

The row electrode 32 corresponding to the pressure chamber 5 of "ROW 2, COLUMN A" corresponds also to the pressure chamber 5 of "ROW 2, COLUMN B", since this row electrode 32 is configured to straddle these two pressure chambers 5. Further, the column electrode 34 corresponding to the pressure chamber 5 of "ROW 1, COLUMN B" corresponds also to the pressure chamber 5 of "ROW 2, COLUMN B", since this column electrode 34 is configured to straddle all of the pressure chambers 5 arranged in the "COLUMN B". Thus, the drive voltages "0V", "0V" are applied to the row and column electrodes 32, 34 corresponding to the pressure chamber 5 of "ROW 2, COLUMN B", respectively. Consequently, in the actuator 20 corresponding to the pressure chamber 5 of "ROW 2, COLUMN B", the sum of the deformations of the deformable portions of the actuator 20 corresponding to the pressure chamber 5 of "ROW 2, COLUMN B" amounts to "0", which is smaller than "+5" as the minimum amount required to cause the ink droplet to be ejected from the pressure chamber 5.

In the second embodiment, the number of outputs that are required to be supplied from the controller is (m+n), i.e., a total of the number (m) of the row electrodes 32 and the number (n) of the column electrodes 34. Where m=75, n=2, the required number of outputs will be 77 that is still smaller than the required number of outputs (79) in the above-described first embodiment. That is, in the second embodiment, the controller circuit can be further simplified and accordingly constructed at a further reduced cost.

While preferred embodiments of the present invention have been described in detail with reference to the accompanying drawings, the present invention may be otherwise embodied.

In the above-described first and second embodiments, each column electrode 34 (and each common electrode 35) is arranged to straddle all of the pressure chambers 5 arranged in a corresponding one of the columns, while each row electrode 32 is arranged to straddle all of the pressure chambers 5 arranged in a corresponding one of the rows. However, each of the row, column, common electrodes 32, 34, 35 does not necessarily have to straddle all of the pressure chambers 5 arranged in a corresponding one of the rows or columns. That is, each of the row, column, common electrodes 32, 34, 35 may be divided into two or more.

Further, in the above-described first and second embodiments, the inkjet head is arranged such that the inkjet droplet is ejected from the pressure chamber 5 when the amount of expansion (positive amount of deformation) of the entirety of the actuator 20 corresponding to this pressure chamber 5 exceeds a predetermined amount or threshold. However, the inkjet head may be arranged such that the droplet is ejected from the pressure chamber 5 when the amount of contraction (negative amount of deformation) of the entirety of the actuator 20 corresponding to this pressure chamber 5 exceeds a predetermined amount, namely, when the deformable portions of the actuator 20 are caused to contract by an amount exceeding the predetermined amount.

Figure 15:
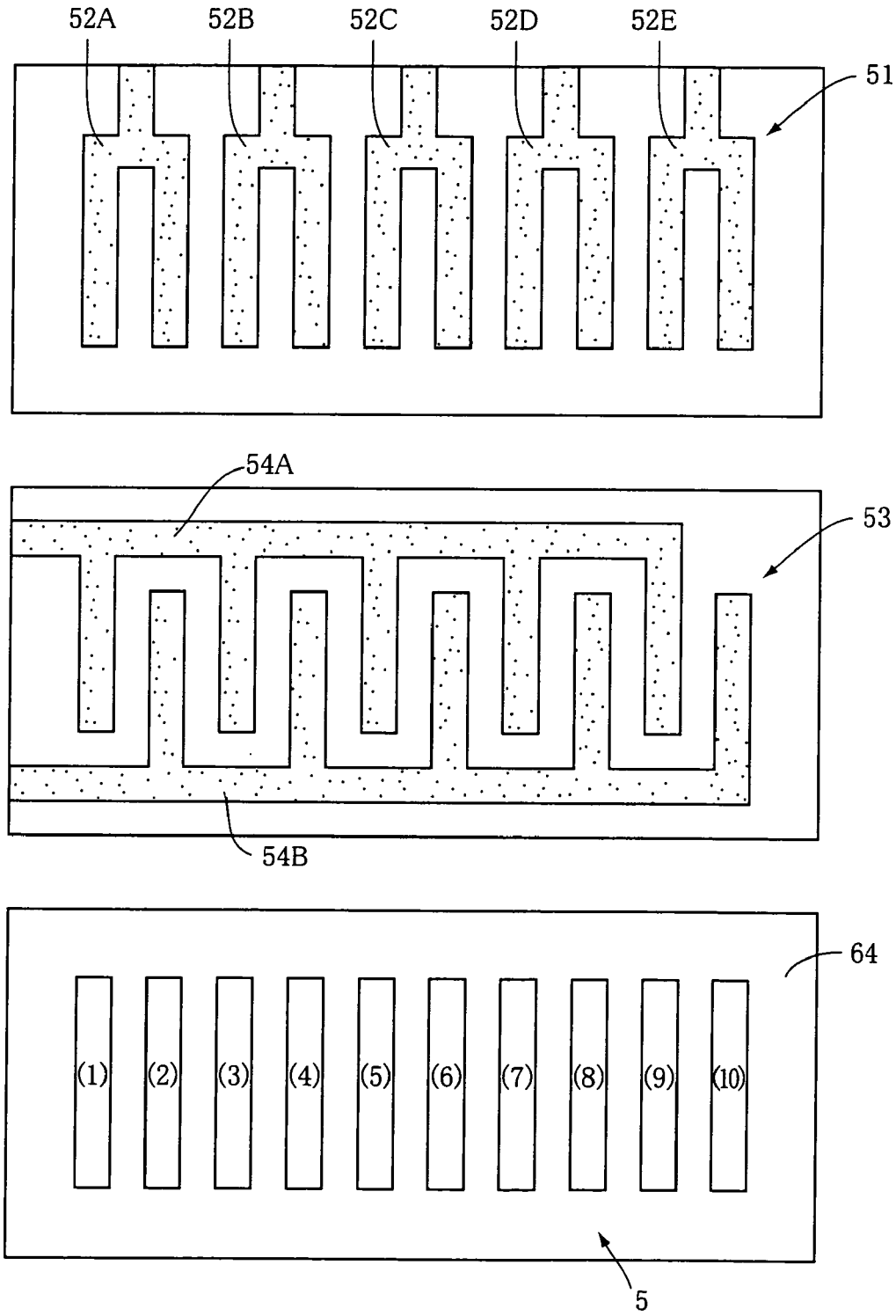
FIG. 15 is a set of plan views showing an arrangement of electrodes in a case where the pressure chambers are arranged in a single column.

Further, in the above-described first and second embodiments, the nozzles 4 and the pressure chambers 5 are arranged in a matrix consisting of a plurality of rows and columns. However, the present invention is applicable to a case where the nozzles 4 and the pressure chambers 5 are arranged in a single row or column. FIG. 15 is a set of plan views showing a first electrode layer 51, a second electrode layer 53 and a cavity plate 64 which are superposed on one another, in a case where the nozzles 4 and the pressure chambers 5 are arranged in a single column. It is noted that, in the following description with reference to FIG. 15, the number of the pressure chambers 5 is ten, which is much smaller than actually it is, for easier understanding of the description.

In this arrangement shown in FIG. 15, ten pressure chambers 5(1), 5(2), 5(3), . . . , 5(10) are sorted in two different manners. Described specifically, the ten pressure chambers 5 are sorted into five groups according to a first manner as one of the two different manners, while being sorted into two groups according to a second manner as the other of the two different manners. The five groups formed by sorting according to the first manner consist of: a group constituted by the pressure chambers 5(1), 5(2), a group constituted by the pressure chambers 5(3), 5(4); a group constituted by the pressure chambers 5(5), 5(6); a group constituted by the pressure chambers 5(7), 5(8); and a group constituted by the pressure chambers 5(9), 5(10). The two groups formed by sorting according to the second manner consist of: a group constituted by the pressure chambers 5(1), 5(3), 5(5), 5(7) and 5(9); and a group constituted by the pressure chambers 5(2), 5(4), 5(6), 5(8) and 5(10). The first electrode layer 51 includes five first electrodes 52A, 52B, 52C, 52D and 52E, while the second electrode layer 53 includes two second electrodes 54A, 54B. The first and second electrodes 52, 54 are arranged and configured such that each of the electrodes 52, 54 corresponds to the pressure chambers 5 belonging to one of the groups which is formed by sorting in a corresponding one of the first and second manners, so that each of the pressure chambers 5 corresponds to two of the electrodes 52, 54. For example, the pressure chamber 5(1) overlaps, as viewed in a direction in which the first electrode layer 51, second electrode layer 53 and cavity plate 64 are superposed on one another, with the first and second electrodes 52A, 54A, so that the ejection of the ink droplet from the pressure chamber 5(1) is controlled by controlling an electric voltage applied to each of the electrodes 52A, 54A. The pressure chamber 5(2) overlaps with the first and second electrodes 52A, 54B, so that the ejection of the ink droplet from the pressure chamber 5(2) is controlled by controlling an electric voltage applied to each of the electrodes 52A, 54B.

As is apparent from the above description, in the arrangement of FIG. 15, too, the required number of outputs (i.e., required number of the electrodes 52, 54) can be smaller than the number of the pressure chambers 5 (i.e., number of the nozzles).

It is to be understood that the present invention is applicable not only to the inkjet head but also to other droplet ejection device.

What is claimed is:

1. A droplet ejection device comprising:

a cavity unit having a plurality of nozzles and a plurality of pressure chambers which are held in communication with the respective nozzles;

an actuator unit including a plurality of actuators corresponding to the respective pressure chambers, such that each of said actuators is operable to change a volume of a corresponding one of said pressure chambers whereby a droplet is ejected from said corresponding one of said pressure chambers through a corresponding one of said nozzles; and a controller operable to control ejection of the droplet from each of said pressure chambers, wherein said plurality of actuators include at least four electrodes and a piezoelectric body, wherein said at least four electrodes are provided by a plurality of electrode layers each including at least two of said at least four electrodes, said at least two of said at least four electrodes being electrically independent from each other, wherein said piezoelectric body is provided by at least one piezoelectric layer interposed between said plurality of electrode layers, wherein said pressure chambers are sorted into groups in at least two different manners, such that each of said pressure chambers belongs to at least two groups which are formed by sorting in the respective different manners, wherein each of said at least four electrodes is arranged to correspond to at least two of said pressure chambers belonging to one of said groups which is formed by sorting in a corresponding one of said at least two different manners, so that each one of said pressure chambers corresponds to at least two corresponding ones of said at least four electrodes, and wherein said controller controls an electric voltage that is to be applied to each of said at least two corresponding ones of said at least four electrodes, for controlling ejection of the droplet from said each one of said pressure chambers.

2. The droplet ejection device according to claim 1, wherein each of said pressure chambers has a portion overlapping, as viewed in a direction in which said actuator unit is superposed on said cavity unit, with at least two of said at least four electrodes to which said each of said pressure chambers corresponds.

3. The droplet ejection device according to claim 1, wherein said at least four electrodes includes (i) a plurality of first electrodes provided by a first electrode layer as one of said plurality of electrode layers and (ii) a plurality of second electrodes provided by a second electrode layer as one of said plurality of electrode layers, wherein said pressure chambers are sorted in first and second manners as said at least two different manners, such that each of said pressure chambers belongs to one of said groups formed by sorting in said first manner and one of said groups formed by sorting in said second manner, wherein each of said first electrodes is arranged to correspond to at least two of said pressure chambers belonging to one of said groups formed by sorting in said first manner, while each of said second electrodes is arranged to correspond to at least two of said pressure chambers belonging to one of said groups formed by sorting in said second manner, so that each one of said pressure chambers corresponds to one corresponding of said first electrodes and one corresponding of said second electrodes, and wherein said controller controls the ejection of the droplet from said each one of said pressure chamber, by controlling the electric voltage that is to be applied to each of said one corresponding of said first electrodes and said one corresponding of said second electrodes.

4. The droplet ejection device according to claim 3, wherein said pressure chambers are arranged in a matrix including a plurality of rows and columns, such that at least two of said pressure chambers arranged in a same one of said rows belong to a same one of said groups formed by sorting in said first manner, and such that at least two of said pressure chambers arranged in a same one of said columns belong to a same one of said groups formed by sorting in said second manner, and wherein each of said first electrodes is configured to straddle said at least two of said pressure chambers which are arranged in the same row and which belong to the same group formed by sorting in said first manner, while each of said second electrodes is configured to straddle said at least two of said pressure chambers which are arranged in the same column and which belong to the same group formed by sorting in said second manner.

5. The droplet ejection device according to claim 3, wherein said piezoelectric body is provided by a plurality of piezoelectric layers as said at least one piezoelectric layer, wherein said actuator unit includes, in addition to said first and second electrode layers, a third electrode layer providing at least two third electrodes which are opposed to said first electrodes with at least one of said piezoelectric layers being interposed between said first and third electrodes, and which are opposed to said second electrodes with at least one of said piezoelectric layers being interposed between said second and third electrodes, such that each of said plurality of actuators for a corresponding one of said pressure chambers includes a first deformable portion interposed between said first and third electrodes and a second deformable portion interposed between said second and third electrodes, and wherein said controller controls the ejection of the droplet from each of said pressure chambers, by controlling deformation of said first deformable portion and deformation of said second deformable portion.

6. The droplet ejection device according to claim 5, wherein said controller controls a sum of the deformations of said first and second deformable portions of each of said plurality of actuators, such that said sum exceeds a threshold where the droplet is to be ejected from a corresponding one of said pressure chambers, and such that said sum does not exceed said threshold where the droplet is not to be ejected from the corresponding one of said pressure chambers.

7. The droplet ejection device according to claim 5, wherein said plurality of piezoelectric layers include four piezoelectric layers each of which is interposed between a corresponding adjacent pair of said electrode layers adjacent to each other, and wherein said actuator unit includes said first electrode layer, said second electrode layer and three third electrode layers each provided by said third electrode layer, which are superposed on each other in an order of said third electrode layer, first electrode layer, third electrode layer, second electrode layer and third electrode layer.

8. The droplet ejection device according to claim 5, wherein said controller includes a selective-ejection controlling portion operable to allow the ejection of the droplet from a selected one of said pressure chambers belonging to a same one of said groups formed by sorting in said first manner, while inhibiting the ejection of the droplet from a non-selected one of said pressure chambers belonging to the same group, wherein said selective-ejection controlling portion establishes, between at least one of said third electrodes and one of said first electrodes that straddles said pressure chambers belonging to said same group, an electric potential difference causing the first deformable portions corresponding to the respective pressure chambers, to be deformed in a first direction, and wherein said selective-ejection controlling portion establishes, between at least one of said third electrodes and one of said second electrodes that corresponds to said non-selected one of said pressure chambers, an electric potential difference causing the second deformable portion corresponding to said non-selected one of said pressure chambers, to be deformed in a second direction that is opposite to said first direction.

9. The droplet ejection device according to claim 8, wherein said selective-ejection controlling portion of said controller establishes, between said one of said first electrodes and one of said third electrodes corresponding to said selected one of said pressure chambers, an electric potential difference causing the first deformable portion corresponding to said selected one of said pressure chambers, to be deformed in said first direction by a relatively large amount, and wherein said selective-ejection controlling portion establishes, between said one of said first electrodes and one of said third electrodes corresponding to said non-selected one of said pressure chambers, an electric potential difference causing the first deformable portion corresponding to said non-selected one of said pressure chambers, to be deformed in said first direction by a relatively small amount that is smaller than said relatively large amount.

10. The droplet ejection device according to claim 9, wherein said controller is capable of applying an electric voltage to each of said first, second and third electrodes, such that the electric voltage applicable to each of said second and third electrodes is lower than that applicable to each of said first electrodes.

11. The droplet ejection device according to claim 5, wherein said controller is capable of applying an electric voltage to each of said first, second and third electrodes, such that a ratio of the electric voltage applicable to each of said first electrodes, that applicable to each of said second electrodes and that applicable to each of said at least one third electrode is substantially fixed.

12. The droplet ejection device according to claim 11, wherein said controller selectively applies and suspends the electric voltage to each of said first, second and third electrodes.

13. The droplet ejection device according to claim 3, wherein said plurality of electrode layers consist of at least one first electrode layer each provided by said first electrode layer, and at least one second electrode layer each provided by said second electrode layer, wherein each of said at least one piezoelectric layer is interposed between said first and second electrodes, and wherein said controller controls the ejection of the droplet from each of said pressure chambers, by controlling deformation of a corresponding one of said plurality of actuators.

14. The droplet ejection device according to claim 13, wherein said controller includes a selective-ejection controlling portion operable to allow the ejection of the droplet from a selected one of said pressure chambers belonging to a same one of said groups formed by sorting in said first manner, while inhibiting the ejection of the droplet from a non-selected one of said pressure chambers belonging to the same group, wherein said selective-ejection controlling portion establishes a first electric potential difference between one of said first electrodes that straddles said pressure chambers arranged in said same row, and one of said second electrodes corresponding to said selected one of said pressure chambers, and wherein said selective-ejection controlling portion establishes a second electric potential difference that is different from said first electric potential difference, between said one of said first electrodes and one of said second electrodes corresponding to said non-selected one of said pressure chambers.

15. The droplet ejection device according to claim 1, wherein said at least four electrodes include (i) plurality of first electrodes provided by a first electrode layer as one of said plurality of electrode layers and (ii) a plurality of second electrodes provided by a second electrode layer as one of said plurality of electrode layers, and wherein the electric voltage applicable to each of said plurality of first electrodes and the electric voltage applicable to each of said plurality of second electrodes are different from each other.

* * * * *